US009205657B2

(12) United States Patent
Hirabayashi et al.

(10) Patent No.: US 9,205,657 B2
(45) Date of Patent: Dec. 8, 2015

(54) LIQUID EJECTION HEAD AND LIQUID EJECTION APPARATUS

(71) Applicant: FUJIFILM CORPORATION, Tokyo (JP)

(72) Inventors: Yasutoshi Hirabayashi, Ashigarakami-gun (JP); Shinji Seto, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/226,677

(22) Filed: Mar. 26, 2014

(65) Prior Publication Data

US 2014/0292954 A1 Oct. 2, 2014

(30) Foreign Application Priority Data

Mar. 27, 2013 (JP) ..... 2013-066300

(51) Int. Cl.

*B41J 2/175* (2006.01)
*B41J 2/14* (2006.01)
*B41J 2/155* (2006.01)

(52) U.S. Cl.

CPC ..... *B41J 2/175* (2013.01); *B41J 2/14233* (2013.01); *B41J 2/155* (2013.01); *B41J 2202/12* (2013.01); *B41J 2202/20* (2013.01)

(58) Field of Classification Search

CPC ..... B41J 2/14233; B41J 2/155; B41J 2/175; B41J 2/17509; B41J 2/17513; B41J 2/1752; B41J 2/17553; B41J 2/17596; B41J 2202/12; B41J 2202/20

USPC ..... 347/84, 85

See application file for complete search history.

(56) References Cited

U.S. PATENT DOCUMENTS

| | | | | |
|---|---|---|---|---|
| 2007/0188564 | A1* | 8/2007 | Harvey et al. | 347/85 |
| 2007/0291082 | A1 | 12/2007 | Baumer et al. | |
| 2009/0009553 | A1 | 1/2009 | Hosono | |
| 2011/0007117 | A1 | 1/2011 | Bibl et al. | |
| 2011/0148988 | A1 | 6/2011 | Hoisington et al. | |
| 2012/0113197 | A1 | 5/2012 | Kashu et al. | |
| 2012/0160925 | A1 | 6/2012 | Hoisington et al. | |

FOREIGN PATENT DOCUMENTS

| | | | |
|---|---|---|---|
| JP | 2008-254196 | A | 10/2008 |
| JP | 2009-012376 | A | 1/2009 |
| JP | 2011-520671 | A | 7/2011 |
| WO | 2005/007415 | A2 | 1/2005 |
| WO | 2005/007415 | A3 | 4/2005 |
| WO | 2007/149235 | A1 | 12/2007 |

OTHER PUBLICATIONS

The extended European search report issued by the European Patent Office on Oct. 21, 2014, which corresponds to European Patent Application No. 14161964.3-1701 and is related to U.S. Appl. No. 14/226,677.

An Office Action; "Notification of Reasons for Rejection," issued by the Japanese Patent Office on Jan. 22, 2015, which corresponds to Japanese Patent Application No. 2013-066300 and is related to U.S. Appl. No. 14/226,677;with English language partial translation.

* cited by examiner

*Primary Examiner* — Manish S Shah
*Assistant Examiner* — Roger W Pisha, II
(74) *Attorney, Agent, or Firm* — Studebaker & Brackett PC

(57) ABSTRACT

A liquid ejection head includes: a nozzle including a nozzle opening and a nozzle communication channel communicating at one end thereof with the nozzle opening; a liquid chamber communicating with another end of the nozzle communication channel; a pressurizing element configured to pressurize liquid in the liquid chamber; circulation outlets formed at the nozzle; individual circulation channels communicating with the nozzle; and a common circulation channel at which communication ports respectively communicating with the individual circulation channels are formed, the circulation outlets arranged symmetrically with respect to a nozzle axis passing through a barycenter of the nozzle opening and perpendicular to a nozzle opening surface, and the individual circulation channels respectively communicating with the circulation outlets and a same common circulation channel, flow rates of liquid respectively passing through the circulation outlets when the liquid in the nozzle is circulated to the common circulation channel being equal to each other.

15 Claims, 15 Drawing Sheets

LIQUID EJECTION HEAD AND LIQUID EJECTION APPARATUS

BACKGROUND OF THE INVENTION

1. Field of the Invention

The presently disclosed subject matter relates to a liquid ejection head and a liquid ejection apparatus, and particularly to a channel structure of the liquid ejection head.

2. Description of the Related Art

An inkjet head has been proposed in which a circulation outlet of an individual circulation channel for circulating liquid from a nozzle to a common circulation channel is arranged adjacent to a nozzle opening and which circulates the liquid in the nozzle to the common circulation channel to suppress increase in viscosity (thickening) of the liquid in the nozzle.

Japanese Patent Application Laid-Open No. 2008-254196 describes an inkjet head (recording head) in which a circulation outlet of an individual circulation channel (circulation channel) is arranged adjacent to a nozzle opening and which circulates liquid (ink) in a nozzle to a common circulation channel (common circulation path) via the individual circulation channel to prevent ejection failure.

SUMMARY OF THE INVENTION

However, it has been found that an inkjet head in which an individual circulation channel is arranged adjacent to a nozzle opening has a problem in that an ejection pressure and a viscosity gradient of liquid are uneven to thereby cause ejection bending.

It has also been found that liquid ejection and liquid circulation change the viscosity gradient, and the direction of ejection bending cannot be stable (occurrence of irregular ejection bending (declination of an ejection direction of liquid)).

Japanese Patent Application Laid-Open No. 2008-254196 does not include description or suggestion on a technical problem of ejection bending due to liquid circulation. It can be regarded that, in the inkjet head described in Japanese Patent Application Laid-Open No. 2008-254196, ejection bending occurs owing to liquid circulation.

The presently disclosed subject matter has been made in view of such situations, and has an object to provide a liquid ejection head and a liquid ejection apparatus that can prevent ejection bending caused by circulation of liquid in a nozzle.

In order to achieve the object, the liquid ejection head according to the presently disclosed subject matter includes: a nozzle including a nozzle opening through which liquid is ejected, and a nozzle communication channel communicating at one end thereof with the nozzle opening; a liquid chamber which communicates with another end of the nozzle communication channel; a pressurizing element which is provided at the liquid chamber, the pressurizing element configured to pressurize liquid in the liquid chamber; a plurality of circulation outlets which are formed at the nozzle; a plurality of individual circulation channels which communicate with the nozzle via the respective circulation outlets; and a common circulation channel at which a plurality of communication ports communicating with the respective individual circulation channels are formed, wherein the nozzle has a structure where the plurality of circulation outlets are arranged symmetrically with respect to a nozzle axis which passes through a barycenter of the nozzle opening and is perpendicular to a nozzle opening surface, and the individual circulation channels communicating with the respective circulation outlets further communicate with the same common circulation channel, and the circulation outlets have a structure where flow rates of liquid passing through the respective circulation outlets when the liquid in the nozzle is circulated to the common circulation channel are the same.

According to the presently disclosed subject matter, the plurality of circulation outlets through which liquid in the nozzle is circulated to the common circulation channel, and the plurality of individual circulation channels are provided. The plurality of circulation outlets respectively communicating with the plurality of individual circulation channels are arranged symmetrically with respect to the nozzle axis, and the flow rates of liquid passing through the respective circulation outlets during circulation from the nozzle to the common circulation channel via the respective individual circulation channels are equal to each other. Accordingly, unevenness of flow of liquid in the nozzle is suppressed, and occurrence of ejection bending of liquid is suppressed even when the liquid is circulated from the nozzle to the common circulation channel during ejection of the liquid from the nozzle opening.

DETAILED DESCRIPTION OF THE PREFERRED EMBODIMENTS

Referring to the accompanying drawings, embodiments of the presently disclosed subject matter are hereinafter described in detail.

[Overall Configuration of Inkjet Recording Apparatus]

Figure 1:
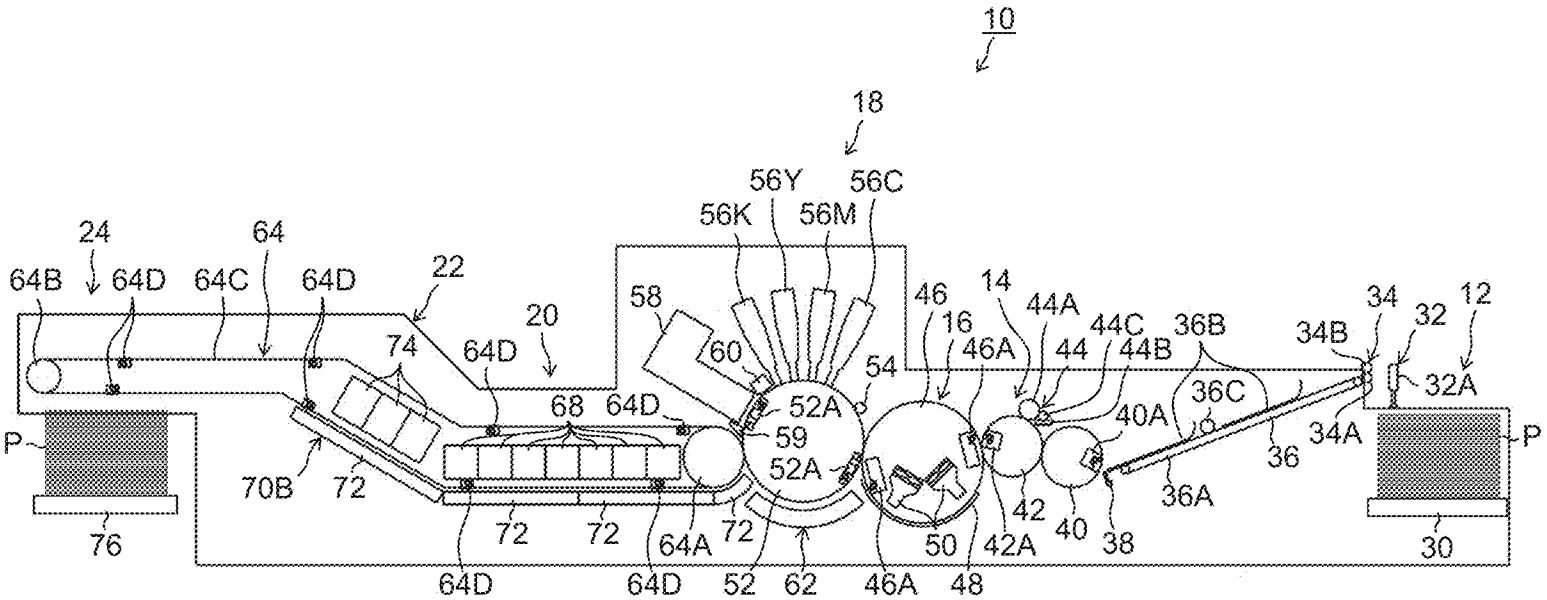
FIG. 1 is a configuration diagram illustrating a schematic configuration of an inkjet recording apparatus according to an embodiment of the presently disclosed subject matter.

FIG. 1 is an overall configuration diagram of an inkjet recording apparatus (liquid ejection apparatus) to which an inkjet head (liquid ejection head) according to an embodiment of the presently disclosed subject matter is applied.

The inkjet recording apparatus 10 illustrated in this diagram is an inkjet recording apparatus for recording an image according to inkjetting through use of aqueous UV ink (UV (ultraviolet) cure ink containing aqueous solvent) onto a sheet of paper P.

The inkjet recording apparatus 10 includes: a paper supply device 12 which supplies the paper P; a process liquid applying device 14 which applies process liquid to a surface of the paper P supplied from the paper supply device 12; a process liquid drying device 16 which performs a process of drying the paper P to which the process liquid has been applied by the process liquid applying device 14; an image forming device 18 which records an image according to inkjetting through use of the aqueous UV ink onto the surface of the paper P to which the drying process has been applied by the process liquid drying device 16; an ink drying device 20 which performs a process of drying the paper P on which the image has been recorded by the image forming device 18; a UV irradiation device 22 which fixes the image by irradiating, with UV light (activation light), the paper P to which the drying process has been applied by the ink drying device 20; and a paper ejection device 24 which ejects the paper P to which the UV irradiation process has been applied by the UV irradiation device 22.

The paper P may be general printing paper, such as a coated paper (an art paper, a coated paper, a low coat weight paper, a coated fine paper, etc.). Here, "coated paper" has a coating layer made by applying coating material to a surface of a high-quality paper, a neutralized (acid-free) paper or the like having not been subjected to surface treatment.

<Paper Supply Device>

The paper supply device 12 includes: a paper supply table 30; a sucker 32; a paper supply roller pair 34; a feeder board 36; a front regulator 38; and a paper supply drum 40. Sheets of paper P stacked on the paper supply table 30 are supplied one by one to the process liquid applying device 14.

The sheets of paper P stacked on the paper supply table 30 are raised from the top on a sheet-by-sheet basis by the sucker 32 (suction fit 32A) and supplied to the paper supply roller pair 34 (between the pair of upper and lower rollers 34A and 34B).

The paper P supplied to the paper supply roller pair 34 is fed forward by the pair of upper and lower rollers 34A and 34B, and stacked on the feeder board 36. The paper P stacked on the feeder board 36 is conveyed by a tape feeder 36A provided on a conveyance surface of the feeder board 36.

The sheet is pressed against the conveyance surface of the feeder board 36 by a retainer 36B and a guide roller 36C during a conveyance process, thereby correcting unevenness. The front end of the paper P conveyed by the feeder board 36 comes into contact with the front regulator 38, thereby correcting the inclination. The paper is then passed to the paper supply drum 40. The paper is gripped at the front end by a gripper 40A of the paper supply drum 40 and conveyed to the process liquid applying device 14.

<Process Liquid Applying Device>

The process liquid applying device 14 includes: a process liquid applying drum 42 which conveys the paper P; and a process liquid applying unit 44 which applies prescribed process liquid to a surface of the paper P conveyed by the process liquid applying drum 42. The process liquid applying device 14 applies the process liquid to the surface of the paper P.

As to the process liquid applied to the surface of the paper P, the process liquid has a function of aggregating coloring materials in aqueous UV ink which is to be deposited on the paper P by the image forming device 18 at a later stage. The application of the process liquid to the surface of the paper P and deposition of the aqueous UV ink can achieve high quality printing without causing deposition interference and the like even through use of general printing paper.

The paper P passed from the paper supply drum 40 of the paper supply device 12 is then passed to the process liquid applying drum 42. The process liquid applying drum 42 causes a gripper 42A to grip (take) the front end of the paper P and rotates, thereby rolling the paper P on the periphery and conveying the paper.

In this conveyance process, an application roller 44A, to which a constant amount of process liquid measured by an anilox roller 44C from a process liquid pan 44B has been applied, is pressed against the surface of the paper P, thereby applying the process liquid to the surface of the paper P. The mode of applying the process liquid is not limited to roller application. Alternatively, another mode, such as inkjetting or application using a blade, may be adopted.

<Process Liquid Drying Device>

The process liquid drying device 16 includes: a process liquid drying drum 46 which conveys the paper P; a paper conveyance guide 48 which supports (guides) the underside of the paper P; and a process liquid drying unit 50 which blows a hot wind to the surface of the paper P conveyed by the process liquid drying drum 46 to dry the paper. This device applies a drying process to the paper P having the surface to which the process liquid has been applied.

The front end of the paper P passed from the process liquid applying drum 42 of the process liquid applying device 14 to the process liquid drying drum 46 is gripped by a gripper 46A included in the process liquid drying drum 46.

The underside of the paper P is supported by the paper conveyance guide 48 in a state where the surface (the surface to which the process liquid is applied) of the paper P faces inward. In this state, the process liquid drying drum 46 is rotated to convey the paper P.

In the process of conveyance by the process liquid drying drum 46, hot wind is blown from the process liquid drying unit 50 provided in the process liquid drying drum 46 to the surface of the paper P to apply the drying process to the paper P, thereby removing a solvent component in the process liquid and forming an ink aggregation layer on the surface of the paper P.

<Image Forming Device>

The image forming device 18 includes: an image formation drum 52 which conveys the paper P; a paper pressing roller 54 which presses the paper P conveyed by the image formation drum 52 to cause the paper P to come into contact with the periphery of the image formation drum 52; inkjet heads 56C, 56M, 56Y and 56K which respectively eject ink droplets having colors C, M, Y and K on the paper P; an in-line sensor 58 which reads the image recorded on the paper P; a mist filter 60 which captures ink mist; and a drum cooling unit 62. The image forming device 18 deposits droplets of ink (aqueous UV ink) having C, M, Y and K colors on the surface of the paper P on which the process liquid layer has been formed, thereby painting a color image on the surface of the paper P.

Various ejection schemes are applicable to the inkjet head adopted in this example. The schemes may be the piezoelectric scheme which utilizes deformation of a piezoelectric element to eject ink (see FIG. 6), a thermal scheme which heats ink to cause a film boiling phenomenon and eject ink, and the electrostatic scheme which deposits charged ink to a recording medium by means of an electrostatic force.

The inkjet head adopted in this example may be a line type head in which a nozzle is formed across a length corresponding to a total width of the paper P (the total length of the paper P in a main scanning direction orthogonal to a conveyance direction), or a short serial head which is shorter than the total width of the paper P.

The front end of the paper P passed from the process liquid drying drum 46 of the process liquid drying device 16 to the image formation drum 52 is gripped by a gripper 52A of the image formation drum 52. Furthermore, the paper P is caused to pass under the paper pressing roller 54 and thus comes into close contact with the periphery of the image formation drum 52.

The paper P in close contact with the periphery of the image formation drum 52 is sucked by a negative pressure caused through suction holes formed on the periphery of the image formation drum 52, and thus sucked and held on the periphery of the image formation drum 52.

While the paper P sucked and held on the periphery of the image formation drum 52 and conveyed passes through ink deposition areas beneath the respective inkjet heads 56C, 56M, 56Y and 56K, droplets of ink respectively having colors of C, M, Y and K are ejected from the inkjet heads 56C, 56M, 56Y and 56K and deposited on the surface; the deposition prints a color image on the surface.

The ink deposited on the surface of the paper P reacts with the ink aggregation layer formed on the surface of the paper P, and fixed on the surface of the paper P without causing feathering, bleeding and the like, thereby forming a high quality image on the surface of the paper P.

While the paper P on which the image has been formed by the inkjet heads 56C, 56M, 56Y and 56K passes through a reading area of the in-line sensor 58, the image formed on the surface is read out.

The image is read out by the in-line sensor 58 as necessary. According to readout data of the image, image failure (image abnormality), such as ejection failure and concentration unevenness, is tested. The paper P having passed through the reading area of the in-line sensor 58 is released from the suction, and subsequently is passed under a guide 59 to the ink drying device 20.

<Ink Drying Device>

The ink drying device 20 includes an ink drying unit 68 which applies a drying process to the paper P conveyed by the chain gripper 64. The ink drying device 20 applies the drying process to the paper P on which the image has been formed, thereby removing a liquid component remaining on the surface of the paper P.

An example of the configuration of the ink drying unit 68 is an embodiment including a heat source, such as a halogen heater or an infrared (IR) heater, and a fan for blowing air (gas or fluid) heated by the heat source to the paper P.

The front end of the paper P passed from the image formation drum 52 of the image forming device 18 to the chain gripper 64 is gripped by grippers 64D included in the chain gripper 64.

The chain gripper 64 has a structure including a first sprocket wheel 64A, a second sprocket wheel 64B, and a pair of endless chains 64C wrapped around the wheels.

The underside of the paper P at the rear end is sucked and held by the paper holding surface of a guide plate 72 arranged in a manner of being separated by a prescribed distance from the chain gripper 64.

<UV Irradiation Device>

The UV irradiation device 22 (activation light irradiation device) includes a UV irradiation unit 74. The UV irradiation device 22 irradiates the image recorded using the aqueous UV ink with ultraviolet light to fix the image on the surface of the paper P.

An example of the configuration of the UV irradiation unit is an embodiment including: an ultraviolet light source which emits UV light; a device which condenses UV light; and an optical system which functions as a device for deflecting UV light and the like.

When the paper P conveyed by the chain gripper 64 reaches a UV light irradiation area of the UV irradiation unit 74, the UV irradiation unit 74 provided in the chain gripper 64 applies a UV irradiation process.

That is, the paper P conveyed by the chain gripper 64 while the front end is gripped by the gripper and the underside of the rear end is sucked and held by the paper holding surface is irradiated with UV light by the UV irradiation unit 74 arranged at a position corresponding to the surface of the paper P in a conveyance path for the paper P. In the image (ink) irradiated with the UV light, curing reaction occurs, and the image is fixed to the surface of the paper P.

The paper P subjected to the UV irradiation process passes through an inclined conveyance path 70B and is then conveyed to the paper ejection device 24. A cooling processor which applies a cooling process to the paper P passing through the inclined conveyance path 70B may be provided.

<Paper Ejection Device>

The paper ejection device 24, which collects the paper P having been subjected to a series of image forming process, includes a paper ejection table 76 which collects sheets of the paper P in a stacked manner.

The chain gripper 64 (gripper 64D) releases the paper P on the paper ejection table 76, and stacks sheets of paper P on the paper ejection table 76. The paper ejection table 76 collects the sheets of paper P released from the chain gripper 64 in a stacked manner. The paper ejection table 76 is provided with paper regulators (a front paper regulator, a rear paper regulator, side paper regulators, etc.), not illustrated, for stacking sheets of paper P in an orderly manner.

The paper ejection table 76 is arranged in a manner capable of ascending and descending by means of a paper ejection table ascent and descent device, not illustrated. The paper ejection table ascent and descent device is controlled to be driven according to increase and decrease of sheets of paper P stacked on the paper ejection table 76, and raises and lowers the paper ejection table 76 so as to always keep the top of paper P at a prescribed height.

<Description on Control System>

Figure 2:
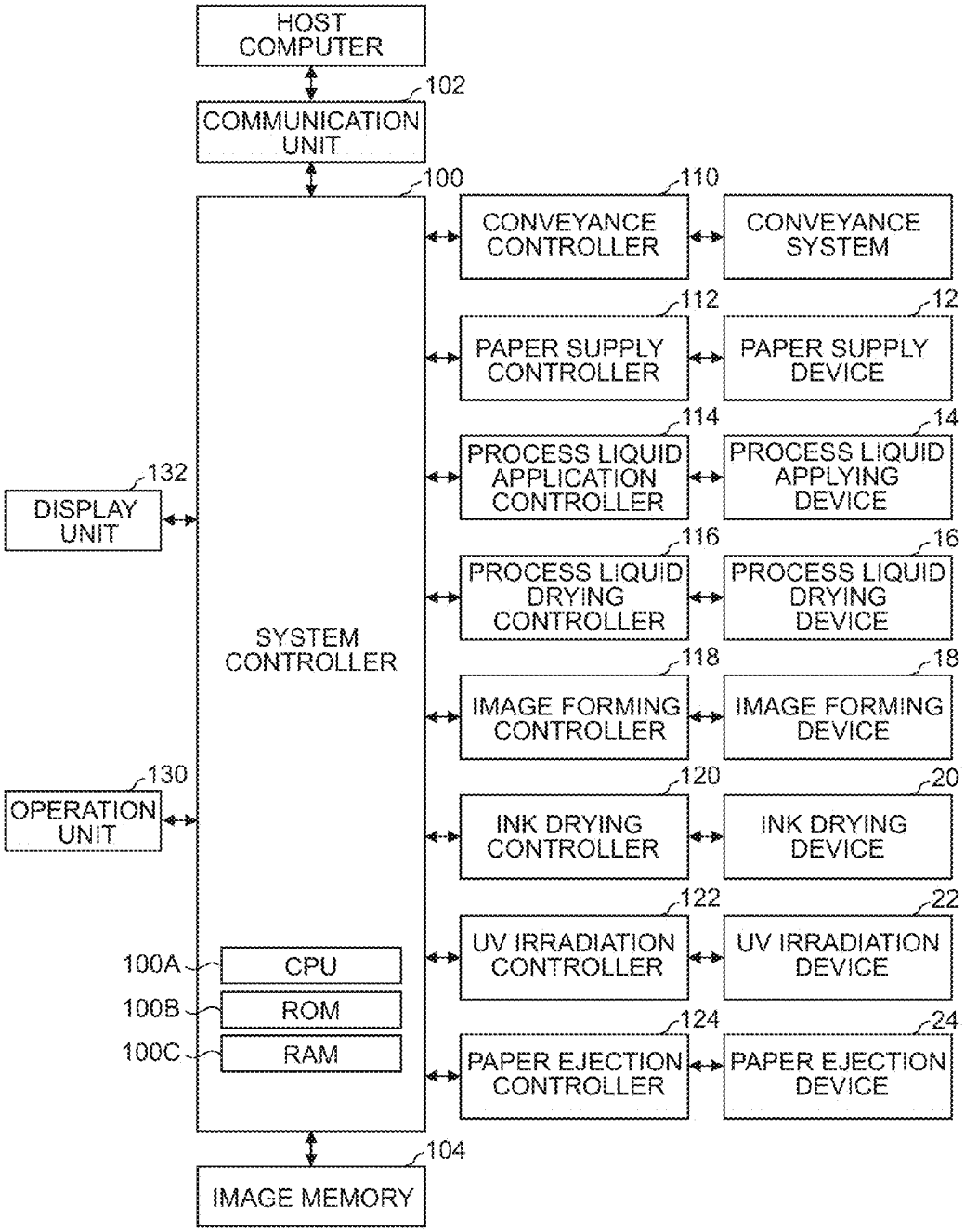
FIG. 2 is a block diagram illustrating a configuration of a control system of the inkjet recording apparatus illustrated in FIG. 1.

FIG. 2 is a block diagram illustrating a schematic configuration of a control system of the inkjet recording apparatus 10 illustrated in FIG. 1.

As illustrated in this diagram, the inkjet recording apparatus 10 includes: a system controller 100; a communication unit 102; an image memory 104; a conveyance controller 110; a paper supply controller 112; a process liquid application controller 114; a process liquid drying controller 116; an image forming controller 118; an ink drying controller 120; a UV irradiation controller 122; a paper ejection controller 124; an operation unit 130; a display unit 132.

The system controller 100 functions as a control device which controls the elements of the inkjet recording apparatus 10 in an integrated manner, and also functions as a computation device which performs various computation processes. The system controller 100 internally includes a CPU (central processing unit) 100A, a ROM (read only memory) 100B, and a RAM (random access memory) 100C.

The system controller 100 also functions as a memory controller which controls writing of data onto the memories, such as the ROM 100B, the RAM 100C and the image memory 104, and reading of the data from the memories.

FIG. 2 exemplifies the embodiment in which the system controller 100 internally includes the memories, such as the ROM 100B and the RAM 100C. Alternatively, the memories, such as ROM 100B and the RAM 100C, may be provided outside of the system controller 100.

The communication unit 102 includes a required communication interface, and transmits and receives data to and from a host computer connected to the communication interface.

The image memory 104 functions as a temporary memory device for storing various pieces of data including image data. The data is read and written via the system controller 100. The image data received from the host computer via the communication unit 102 is temporarily stored in the image memory 104.

The conveyance controller 110 controls operations of a conveyance system for the paper P in the inkjet recording apparatus 10 (conveyance of the paper P from the paper supply device 12 to the paper ejection device 24). The conveyance system includes: the tape feeder 36A, the front regulator 38 and the paper supply drum 40 in the paper supply device 12 illustrated in FIG. 1; the process liquid applying drum 42 in the process liquid applying device 14; the process liquid drying drum 46 in the process liquid drying device 16; the image formation drum 52 in the image forming device 18; and the chain gripper 64 which is commonly used by the ink drying device 20, the UV irradiation device 22 and the paper ejection device 24.

The paper supply controller 112 controls operations of the elements of the paper supply device 12, i.e., driving of the paper supply roller pair 34, driving of the tape feeder 36A and the like, according to instructions from the system controller 100.

The process liquid application controller 114 controls operations (the amount of application of process liquid, timing of the application, etc.) of the elements of the process liquid applying device 14, i.e., operations of the process liquid applying unit 44 and the like, according to instructions from the system controller 100.

The process liquid drying controller 116 controls operations of the elements of the process liquid drying device 16, according to instructions from the system controller 100. That is, the process liquid drying controller 116 controls operations of the process liquid drying unit 50 (see FIG. 1), such as drying temperature, the flow rate of drying air, and timing of blowing drying air.

The image forming controller 118 controls ink deposition (ejection) from the image forming device 18 (inkjet heads 56C, 56M, 56Y and 56K) according to instructions from the system controller 100.

That is, the image forming controller 118 in FIG. 2 includes: an image processor which forms dot data from input image data; a drive waveform generator which generates a waveform of a drive voltage; a drive waveform memory which stores the waveform of the drive voltage; and a drive circuit (head driver) which supplies the inkjet heads 56C, 56M, 56Y and 56K with the drive voltages having drive waveforms corresponding to the dot data.

The image processor performs a color separation process of separating input image data (raster data represented as digital values from 0 to 255) into data having RGB colors, a color conversion process of converting the RGB into CMYK, correction processes, such as a gamma correction and a unevenness correction, and a halftone process of converting the data with each color having an M value into the data with each color having an N value (M>N; M is an integer of three or more; and N is an integer of two or more).

According to the dot data generated through the processes by the image processor, deposition timing of each pixel position and the amount of ink deposition are determined. Drive voltages are generated according to the deposition timing at the pixel positions and the amounts of ink deposition. The drive voltages are supplied to the respective inkjet heads 56C, 56M, 56Y and 56K, and ink droplets deposited from the inkjet heads 56C, 56M, 56Y and 56K form dots at respective pixel positions.

The ink drying controller 120 controls operations of the ink drying device 20 according to instructions from the system controller 100. That is, the ink drying controller 120 controls operations of the ink drying unit 68 (see FIG. 1), such as the drying temperature, the flow rate of the drying air, and the timing of ejecting drying air.

The UV irradiation controller 122 controls the amount of UV light irradiation (UV light intensity (amount of irradiation)) from the UV irradiation device 22 according to instructions from the system controller 100, and also controls the timing of UV light irradiation.

The paper ejection controller 124 controls operations of the paper ejection device 24 such that sheets of the paper P are stacked on the paper ejection table 76, according to instructions from the system controller 100.

The operation unit 130 includes operation members, such as operation buttons, a keyboard and a touch panel, and outputs, to the system controller 100, operation information input from the operation devices. The system controller 100 performs various processes according to the operation information output from the operation unit 130.

The display unit 132 includes a display device, such as an LCD panel, and causes the display device to display information including various pieces of setting information of the apparatus and abnormality information, according to instructions from the system controller 100.

[Structure of Inkjet Head]

Next, the structure of the inkjet head according to the embodiment of the presently disclosed subject matter is described in detail.

<Overall Configuration>

Figure 3:
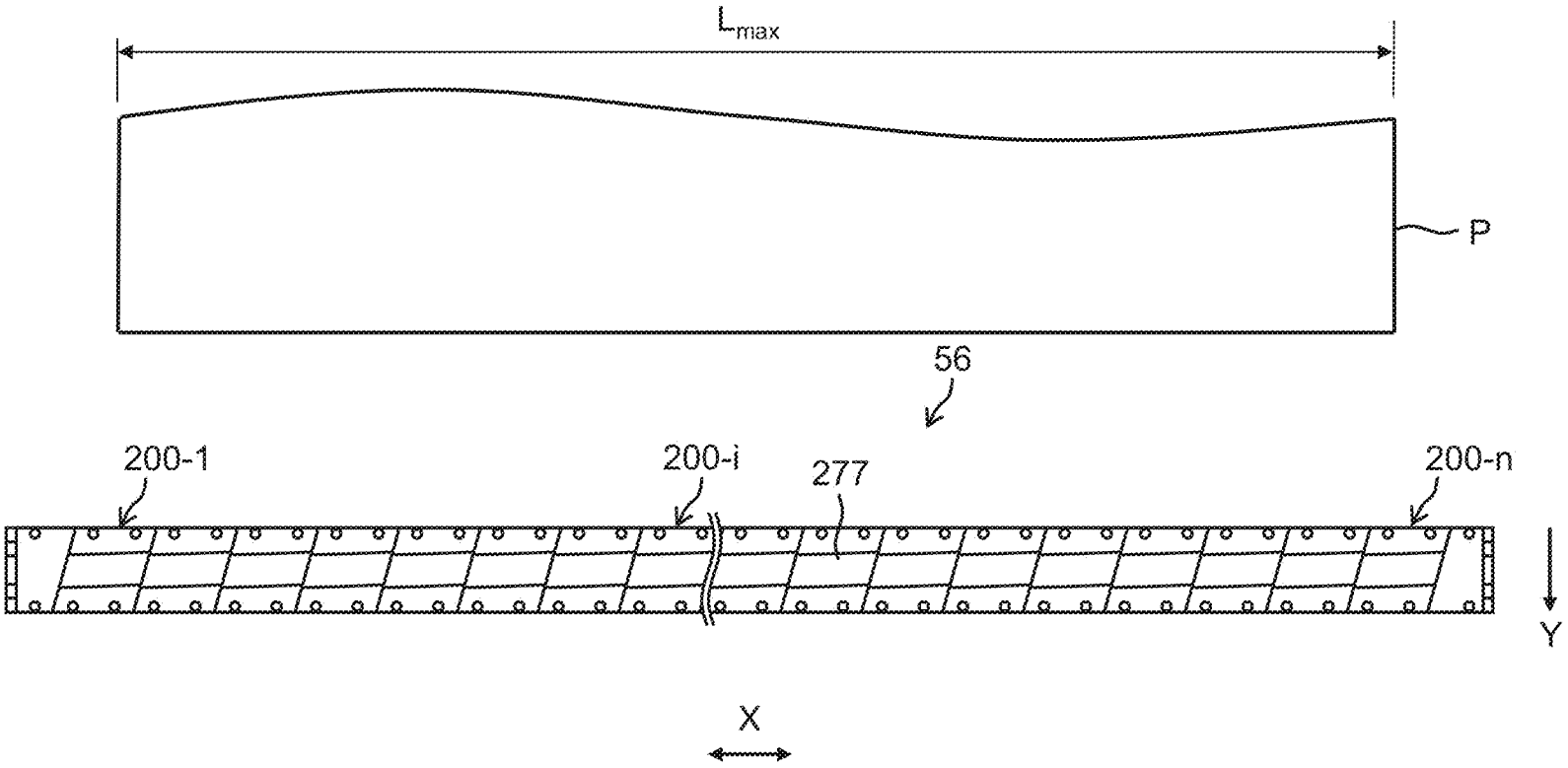
FIG. 3 is a configuration diagram of an inkjet head included in the inkjet recording apparatus illustrated in FIG. 1.

FIG. 3 is a configurational diagram of the inkjet heads 56C, 56M, 56Y and 56K illustrated in FIG. 1. The same structure is applied to the inkjet heads 56C, 56M, 56Y and 56K corresponding to the respective CMYK colors. Accordingly, in the case where the heads are not required to be discriminated, alphabetical characters of the inkjet heads 56C, 56M, 56Y and 56K may be omitted.

The inkjet head 56 illustrated in FIG. 3 has a structure where a plurality of head modules 200 are connected in the width direction of the paper P (X direction) orthogonal to the relative conveyance direction of the paper P (Y direction).

A suffix number (an integer after "-" (hyphen)) appended to the head module 200 designates that the module is the i-th (an integer from 1 to n) head module.

Figure 5:
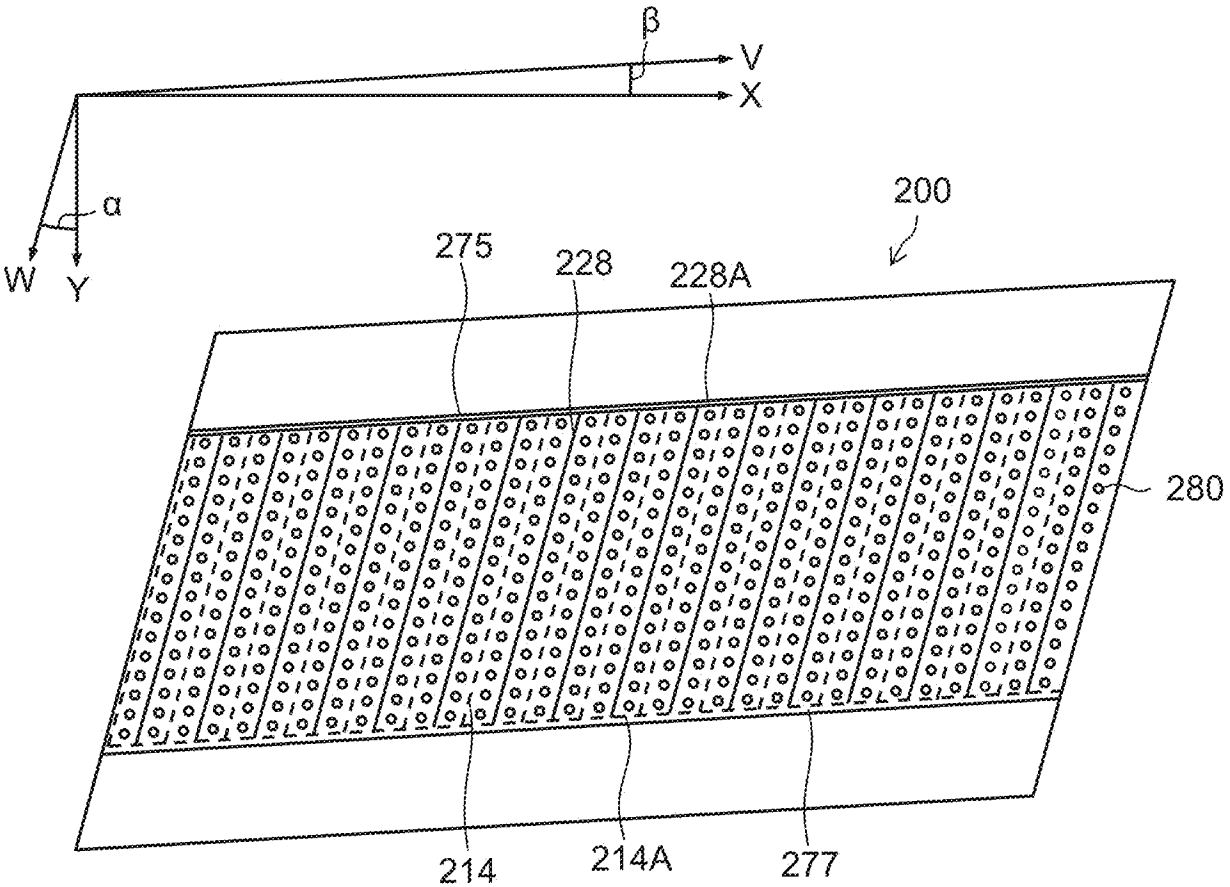
FIG. 5 is a diagram illustrating nozzle arrangement of the head module illustrated in FIG. 4.

An ink ejection surface 277 of each head module 200 has a plurality of nozzle openings (not illustrated in FIG. 3; illustrated using reference numeral 280 in FIG. 5).

That is, the inkjet head 56 illustrated in FIG. 3 is a full line type inkjet head (single-pass and page-wide head) in which a plurality of nozzle openings are arranged across a length corresponding to the total width $L_{max}$ of the paper P.

Here, "the total width $L_{max}$ of the paper P" is a total length of the paper P in an X direction orthogonal to the relative conveyance direction (Y direction) of the paper P. The description of "orthogonal" includes embodiments which generate operational effects analogous to operational effects in the case of intersection substantially at 90° among embodiments with intersection at an angle less than 90° or more than 90°.

<Example of Configuration of Head Module>

Figure 4:
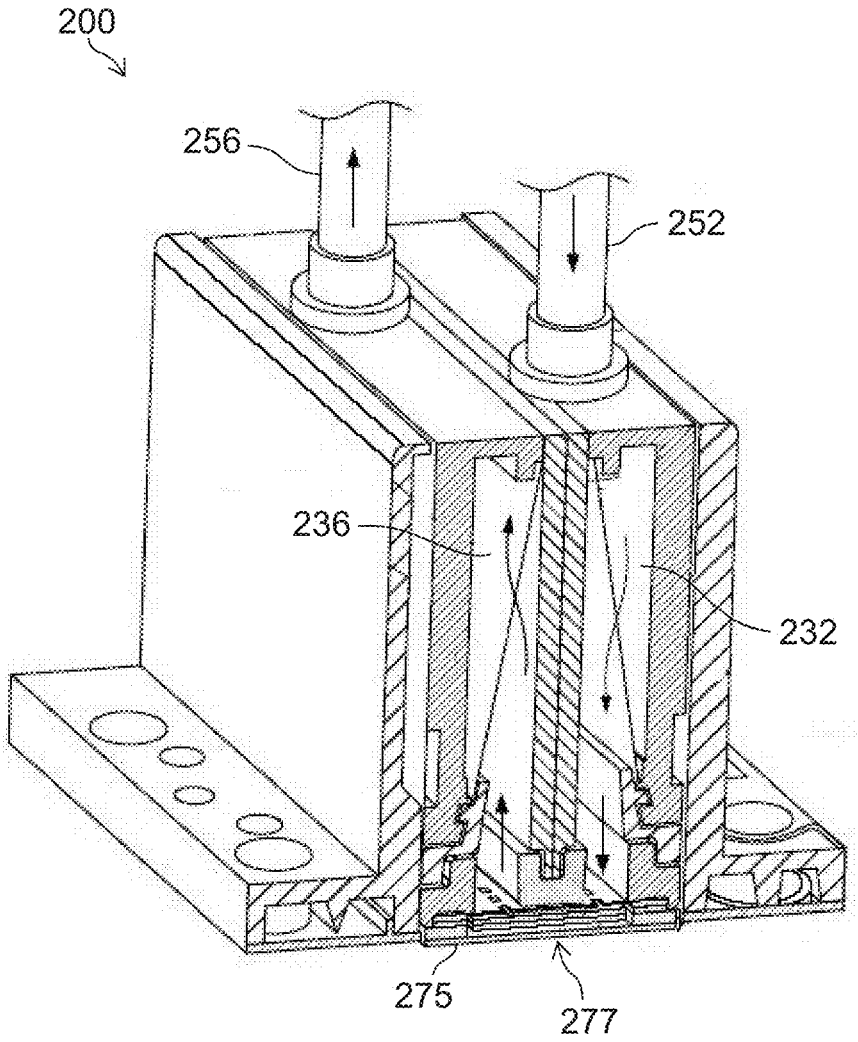
FIG. 4 is a perspective view illustrating an example of a configuration of a head module included in the inkjet head illustrated in FIG. 3.

FIG. 4 is a perspective view (including a partially sectional view) of the head module 200. FIG. 5 is a perspective plan view of a nozzle surface of the head module 200 illustrated in FIG. 4.

As illustrated in FIG. 4, the head module 200 includes an ink supply unit including an ink supply chamber 232, an ink circulation chamber 236, on a side (upper side in FIG. 4) of the nozzle plate 275 opposite to the ink ejection surface 277.

The ink supply chamber 232 communicates with an ink tank (not illustrated) via a supply pipe 252. The ink circulation chamber 236 communicates with a collection tank (not illustrated) via a circulation pipe 256.

In FIG. 5, the number of nozzles is reduced for illustration. However, a plurality of nozzle openings 280 are formed according to a two-dimensional nozzle arrangement on the ink ejection surface 277 of the nozzle plate 275 of one head module 200.

That is, the head module 200 has a planar shape of a parallelogram which has an end face on a longitudinal side along a V direction having an inclination of an angle β from the X direction and an end face on a short side along a W direction having an inclination of an angle α from the Y direction. The plurality of nozzle openings 280 are arranged in a row direction along the V direction and a column direction along the W direction.

A plurality of ink supply channels 214 (indicated by broken lines) and a plurality of common circulation channels 228 (indicated by solid lines) are arranged along the W direction, and an ink supply main channel 214A (indicated by a broken line) communicating with the ink supply channels 214 and a circulation main channel 228A (indicated by a solid line) communicating with the common circulation channels 228 are arranged along the V direction.

In the embodiment illustrated in FIG. 5, the plurality of ink supply channels 214 and the plurality of common circulation channels 228 are alternately arranged between the nozzle arrays; and the ink supply main channel 214A is arranged at one end with respect to the Y direction (lower end of FIG. 5), and the circulation main channels 228A are arranged at the other end with respect to the Y direction (upper end of FIG. 5).

The arrangement of the ink supply channels 214 and the common circulation channels 228 is not limited to the arrangement of the embodiment illustrated in FIG. 5. Alternatively, the arrangement may be appropriately changed.

The arrangement of the plurality of nozzle openings 280 is not limited to the embodiment illustrated in FIG. 5. Alternatively, the nozzle openings 280 may be arranged in the row direction along the X direction and the column direction obliquely intersecting with the X direction.

Figure 6:
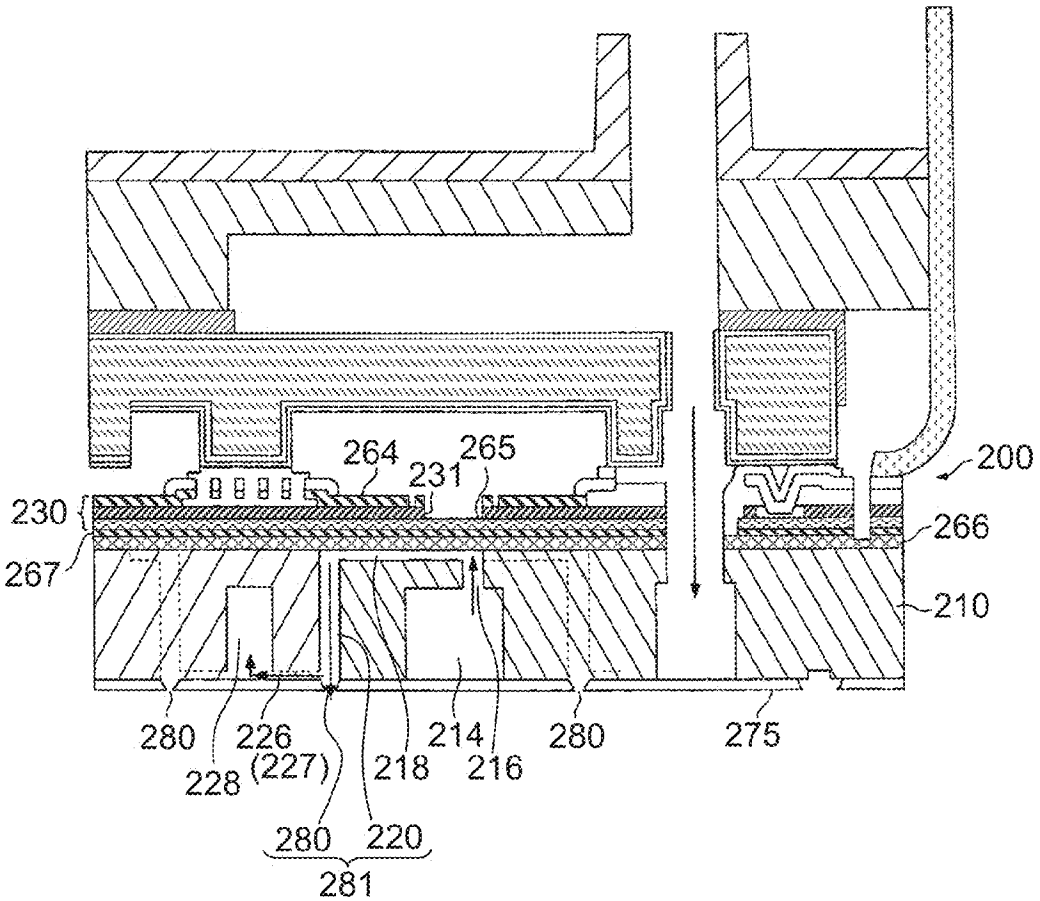
FIG. 6 is a sectional view illustrating an internal configuration of the head module illustrated in FIG. 4.

FIG. 6 is a sectional view illustrating an internal configuration of the head module 200. Reference numeral 214 designates the ink supply channel. Reference numeral 218 designates a pressure chamber (liquid chamber). Reference numeral 216 designates an individual supply channel which communicates between the pressure chamber 218 and the ink supply channel 214. Reference numeral 220 designates a nozzle communication channel which communicates from the pressure chamber 218 to the nozzle opening 280. Reference numeral 226 (227) designates an individual circulation channel which communicates between the nozzle communication channel 220 and the common circulation channel 228.

A diaphragm 266 is provide on a channel structure 210 configuring each of these channels (214, 216, 218, 220, 226 (227) and 228). A piezoelectric element 230 (pressurizing element), which has a stacked structure including a lower electrode (common electrode) 265, a piezoelectric layer 231 and an upper electrode (individual electrode) 264, is arranged on the diaphragm 266 via an adhesive layer 267.

The upper electrode 264 is an individual electrode having been patterned in conformity with the shape of each pressure chamber 218. A piezoelectric element 230 is provided for each pressure chamber 218.

The ink supply channel 214 communicates with the ink supply chamber 232 described with reference to FIG. 4. Ink is supplied from the ink supply channel via the individual supply channel 216 to the pressure chamber 218. A drive voltage is applied to the upper electrode 264 of the piezoelectric element 230 provided for the corresponding pressure chamber 218, according to an image signal of an image to be painted. This application deforms the piezoelectric element 230 and the diaphragm 266, and changes the capacity of the pressure chamber 218. Change in pressure caused owing to changes of the capacity of the pressure chamber 218 ejects ink via the nozzle communication channel 220 out of the nozzle opening 280.

Driving of the piezoelectric elements 230 respectively corresponding to the nozzle openings 280 is controlled according to dot arrangement data generated from image information, thereby allowing ink droplets to be ejected from the nozzle opening 280. While the paper P (see FIG. 3) is conveyed in the Y direction (relative movement direction) at a constant speed, timing of ejecting ink from each nozzle opening 280 is controlled in conformity with the conveyance speed, thereby allowing a desired image to be recorded on paper.

Although not illustrated, the pressure chamber 218 arranged according to each nozzle opening 280 has a planar shape of a substantially regular square. An outlet to the nozzle opening 280 is provided at one of both corners on a diagonal line. An inlet (individual supply channel) 216 for supply ink is provided at the other corner.

The shape of the pressure chamber is not limited to a square. Alternatively, the planar shape of the pressure chamber may be one of various shapes including a quadrilateral (rhombus, rectangle, etc.), a pentagon, a hexagon, another polygon, a circle, and an ellipse.

In the nozzle 281 including the nozzle opening 280 and the nozzle communication channel 220, a circulation outlet (not illustrated in FIG. 6; indicated by reference numerals 226A and 227A in FIG. 9) is formed. The nozzle 281 communicates with the individual circulation channel 226 (227) via the circulation outlet.

A portion of ink in the nozzle 281 which is not used for ejection is collected (circulated) via the individual circulation channel 226 (227) to the common circulation channel 228.

The common circulation channel 228 communicates with the ink circulation chamber 236 described in FIG. 5, and ink is continuously collected through the individual circulation channel 226 to the common circulation channel 228, thereby preventing the ink in the nozzle from thickening during a non-ejection (non-driving) period.

Although detailed description will be provided later, the plurality of circulation outlets are arranged symmetrically (rotationally symmetrically) with respect to the nozzle axis (indicated by reference numeral 281A in FIG. 9) and the plurality of individual circulation channels 226 (227) communicate at positions symmetrical (rotationally symmetrical) with each other with respect to the nozzle axis, in each nozzle 281.

According to such an arrangement of the individual circulation channels 226 (227) and the circulation outlets, the flow rates (volumetric flow rate) of ink passing through the respective circulation outlets are substantially equal to each other, the flow rates of ink circulating from the nozzle 281 to the common circulation channel 228 via the individual circulation channels 226 (227) are substantially identical to each other, unevenness of the flow of ink in the nozzle 281 is suppressed, and occurrence of ejection bending is suppressed.

[Description of Problems of Presently Disclosed Subject Matter]

Figure 7:
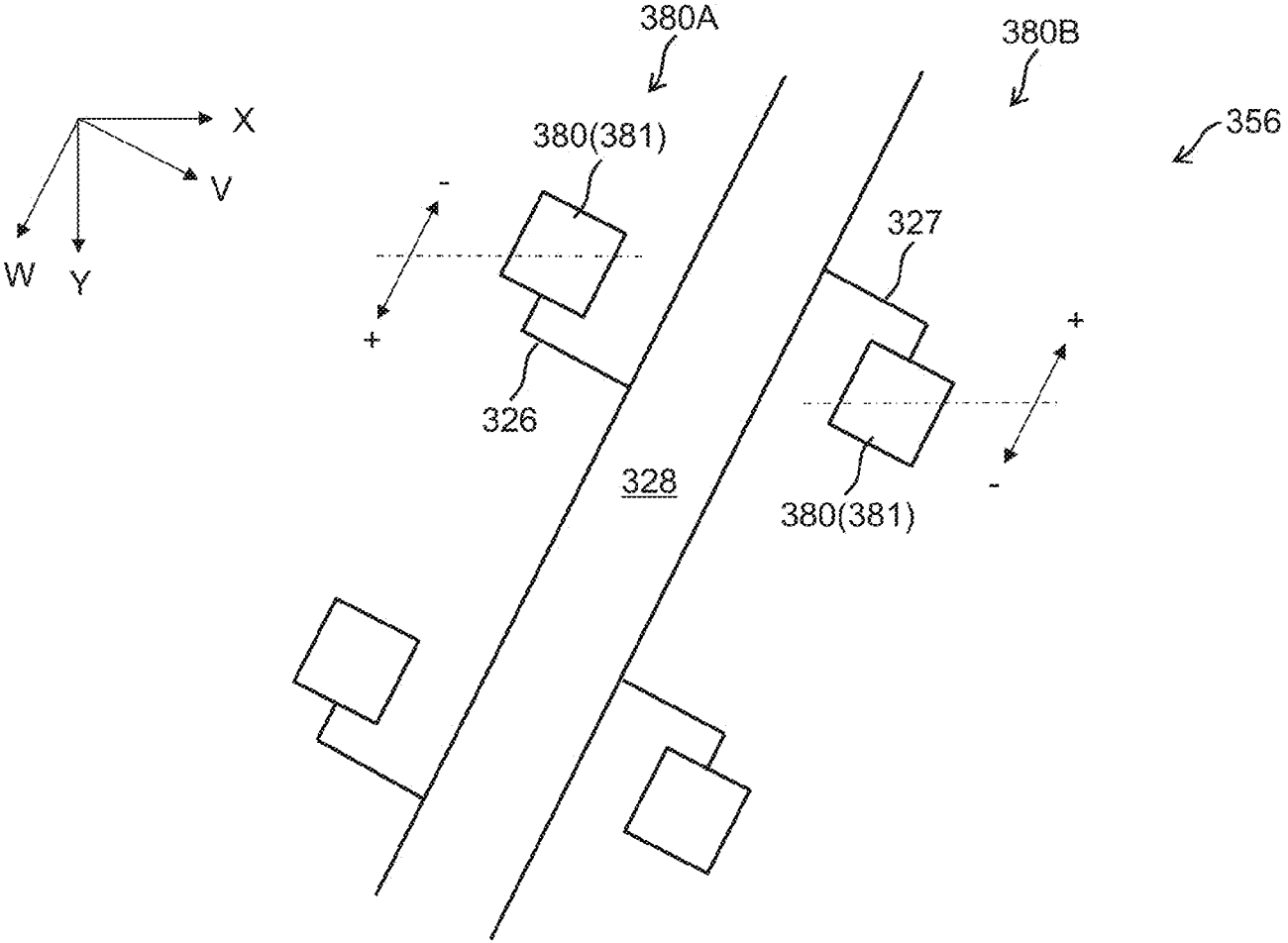
FIG. 7 is a diagram illustrating problems of the presently disclosed subject matter.

First, problems of the presently disclosed subject matter are described. FIG. 7 is a diagram illustrating problems of the presently disclosed subject matter, and a plan view schematically illustrating a channel structure of a full line type inkjet head 356. The inkjet head 356 illustrated in FIG. 7 is provided with individual circulation channels 326 and 327 communicating with a common circulation channel 328. Accordingly, the flow in the nozzle is uneven, which causes ejection bending.

As with the head module 200, in the inkjet head 356 illustrated in this diagram, nozzle openings 380 are arranged in a matrix in the row direction along the V direction and the column direction along the W direction (see FIG. 5).

In the inkjet head 356, each nozzle 381 communicates only with one individual circulation channel 326 (327), and the individual circulation channel 326 of an odd-numbered nozzle array 380A and the individual circulation channel 327 of an even-numbered nozzle array 380B are arranged in opposite directions.

In the inkjet head 356 having the structure illustrated in FIG. 7, each nozzle 381 is provided with the individual circulation channels 326 and 327. Accordingly, the flow of ink in the nozzle 381 is uneven, which may cause ejection bending.

The individual circulation channels 326 and 327 of the odd-numbered nozzle array 380A and the even-numbered nozzle array 380B are arranged opposite to each other with respect to the W direction (the direction in which liquid flows through the individual circulation channel 326 is opposite to the direction in which liquid flows through the individual circulation channel 327). Accordingly, the amount of ejection bending due to the individual circulation channel can be measured by measuring the relative deposition position deviation distance between the odd-numbered nozzle 381 (the left nozzle in the diagram) belonging to the odd-numbered nozzle array 380A and the even-numbered nozzle 381 (right nozzle in the diagram) belonging to the even-numbered nozzle array 380B.

Figure 8:
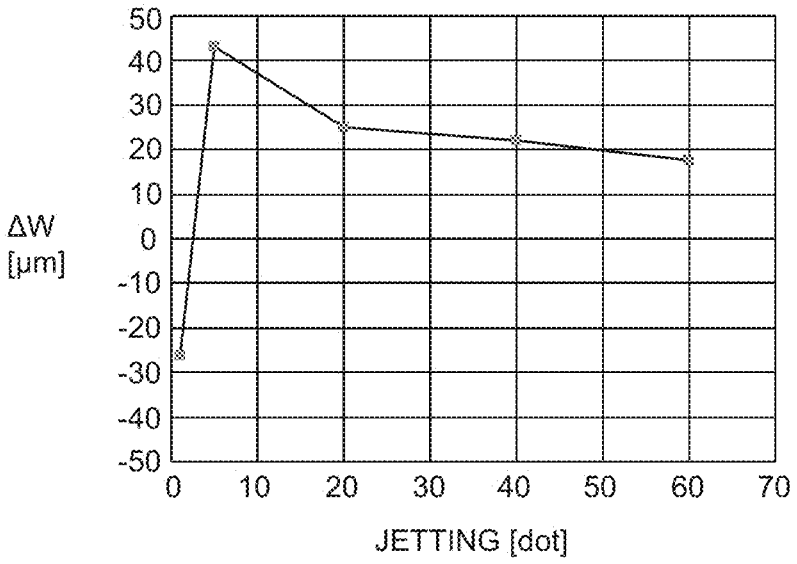
FIG. 8 is a diagram illustrating a relationship of a difference between a number of ink ejections from the inkjet head illustrated in FIG. 7 and an average of relative deposition position deviation distances in a nozzle arrangement direction.

FIG. 8 illustrates a result of measurement of ejection bending of each nozzle 381 through use of the inkjet head 356 having the structure illustrated in FIG. 7. The abscissa of the FIG. 8 indicates the number of ink ejections (jetting [the number of dots]). The ordinate indicates the difference (ΔW [micrometer (μm)]) between the average of relative deposition position deviation distances of the nozzle openings 380 belonging to the odd-numbered nozzle array 380A from the W direction and the average of relative deposition position deviation distances between the nozzle openings 380 belonging to the even-numbered nozzle array 380B from the W direction.

The plus (+) direction of ΔW is a direction designated by + (plus) in FIG. 7, and represents that the actual deposition position deviates toward the side where the individual circulation channel 326 or 327 is arranged. The minus (−) direction of ΔW is a direction designated by − (minus) in FIG. 7, and represents that the actual deposition position deviates away from the individual circulation channel 326 or 327.

The ejection bending is measured as follows. The relative movement between the inkjet head 356 and the paper P (see FIG. 3) is stopped. In a state where the distance between the inkjet head 356 (ink ejection surface) and the paper P is set to one millimeter, ink is ejected multiple times. Deposition positions where droplets (dots) of the number of ink ejections are overlapped with each other are then measured. That is, ΔW represents the amount of position deviation at a center of the deposition positions of the multiple ink ejections.

For the measurement of ΔW, aqueous pigment ink in which coloring material (pigments) are dispersed in an aqueous solvent is used. Micro-vibration driving (driving of piezoelectric elements for vibrating ink in the nozzle within an extent not to eject the ink) for suppressing latency (reduction in ejection speed due to increase in viscosity of ink) during a non-driving state is not adopted.

As illustrated in FIG. 8, it has been proved that if the number of ink ejections is one dot, ejection bending away from the individual circulation channel 326 and 327 (in the minus direction) occurs. It has also been proved that if the number of ink ejections is five dots, large bending toward the individual circulation channel 326 and 327 occurs, and the average resultantly bending toward the individual circulation channel 326 and 327 (plus direction) occurs.

It has further been proved that in the case of setting the number of ink ejections larger, the more the number of ink ejections is increased, the smaller the magnitude of ejection bending becomes. Change in tendency of ejection bending according to the number of ink ejections can be described as follows.

In the case where only one of the individual circulation channels 326 and 327 communicates with one nozzle 381, the ink circulation speed in the nozzle 381 relatively decreases on a side away from the circulation outlet (individual circulation channel 326 or 327) in the nozzle 381, and the viscosity of ink relatively becomes higher.

If the viscosity distribution is uniform in the nozzle 381, the ink ejecting direction is the vertically downward direction from the nozzle opening 380. If the viscosity distribution is uneven, ejection bending occurs toward a relatively high viscosity (slow circulation speed) side.

That is, it can be recognized that in the case of only one time of ink ejection, ejection bending occurs toward a side opposite to the circulation outlet (individual circulation channel 326 or 327).

In the case of multiple times of sequential ink ejections, high viscosity ink in the nozzle 381 having not been ejected gradually flows toward the circulation outlet owing to vibrations of ink in the nozzle 381 caused by ejection and ink flow in nozzle 381 caused by ejection.

It can be recognized that the high viscosity ink thus flows toward the circulation outlet, the ink adjacent to the circulation outlet becomes to have a relatively high viscosity, and ejection bending occurs toward the circulation outlet (individual circulation channel 326 or 327) side.

After ink is further repeatedly ejected, the high viscosity ink is ejected from the nozzle opening, then the bending becomes bending due to the structure of the nozzle 381 itself irrespective of ink thickening, and the bending becomes stationary. It can be recognized that, also in the case where the ink is not thickened, since the ejection pressure from the pressure chamber (see FIG. 6) is released toward the direction of the circulation outlet (designated by reference numerals 226A and 227A in FIG. 9), the pressure on a side of the circulation outlet is reduced, and ejection bending occurs toward the side of the circulation outlet.

In summary, it has been proved that, according to the inkjet head 356, where the nozzle 381 communicates with the individual circulation channels 326 and 327, the ejection bending is caused by unevenness of ink flow in the nozzle 381 due to ink circulation in the nozzle 381 via the individual circulation channels 326 and 327, and change in latency and ink flow.

It has further been recognized that, also in the state where the ink is not thickened, the pressure from the pressure chamber is uneven, which causes ejection bending.

Thus, a configuration to be described below suppresses unevenness of ink flow in the nozzle and thereby suppressing ejection bending.

[Detailed Description on Inkjet Head]

Figure 9A:
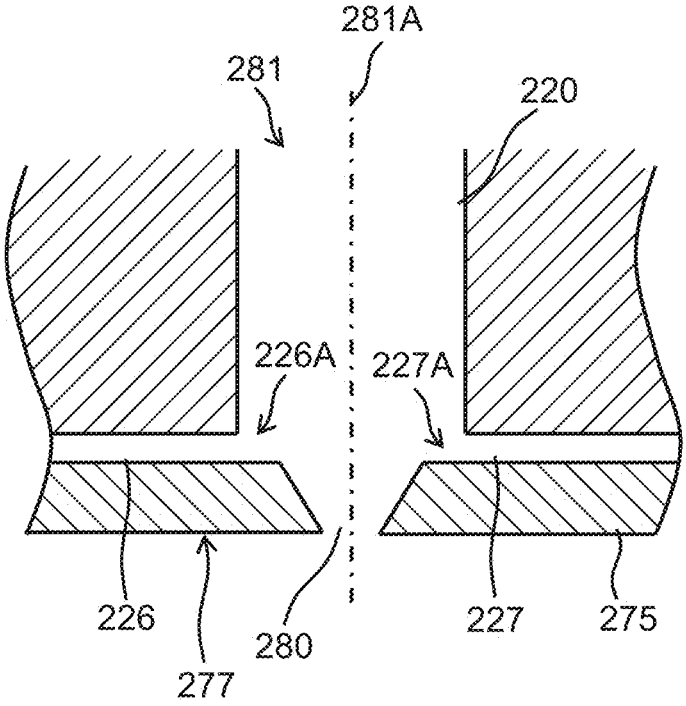
FIG. 9A is a sectional view illustrating an arrangement of a circulation outlet and an individual circulation channel.
Figure 9B:
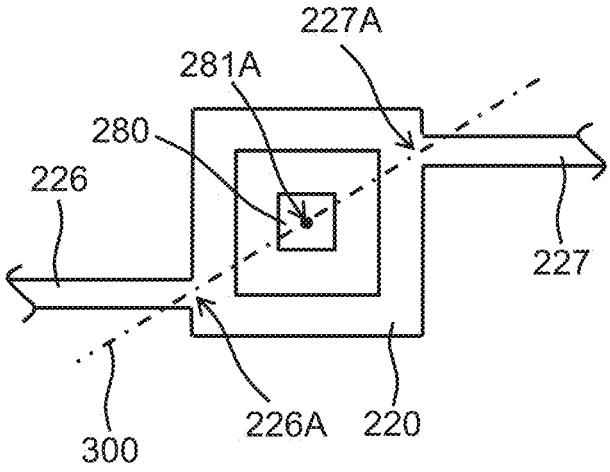
FIG. 9B is a plan view illustrating the arrangement of the circulation outlet and the individual circulation channel.

FIG. 9A is a sectional view illustrating arrangement of the circulation outlets 226A and 227A and the individual circulation channels 226 and 227. FIG. 9B is a plan view illustrating arrangement of the circulation outlets 226A and 227A and the individual circulation channels 226 and 227.

In the following description, the identical reference numerals are assigned to configuration elements identical or similar to the configuration elements described with reference to FIGS. 1 to 6. The description thereof is omitted.

As illustrated in FIGS. 9A and 9B, the two circulation outlets 226A and 227A are formed at the nozzle 281, which communicates with the individual circulation channels 226 and 227 via the respective circulation outlets 226A and 227A. The circulation outlets 226A and 227A are arranged at positions symmetrical with respect to an axis of the nozzle (a nozzle axis) 281A (rotationally symmetric by 180° with respect to the nozzle axis as a rotational axis in a plane parallel to the ink ejection surface 277).

Here, the "nozzle axis" is a line orthogonal to a nozzle opening surface extended from the barycenter (center) 280A of the nozzle opening 280.

The planar shape of the nozzle opening 280 applied to this example may be any shape capable of maintaining symmetry with respect to the nozzle axis 281A. For instance, the circular shape illustrated in FIG. 5 or a square (quadrilateral) illustrated in FIG. 9B may be applied.

Likewise, the shape of the nozzle communication channel 220 may be a cylindrical shape whose sectional shape orthogonal to the nozzle axis 281A is a circle, or a quadrangular prism shape whose sectional shape is a square (quadrilateral).

In the following description, the planar shape of the nozzle opening 280 is square. The sectional shape of the nozzle communication channel 220 which is orthogonal to the nozzle axis 281A is a quadrilateral. The area of the nozzle opening 280 is less than the sectional area of the nozzle communication channel 220.

In order to exert an advantageous effect of suppressing ink thickening in the nozzle 281 to the maximum, it is preferred that the circulation outlets 226A and 227A (individual circulation channels 226 and 227) be formed (arranged) at a position close to the nozzle opening 280 as long as possible.

According to the embodiment illustrated in FIG. 9A, in the nozzle 281 having the shape continuously increasing in area from the nozzle opening 280 to the nozzle communication channel 220, the circulation outlets 226A and 227A are arranged at positions where the area is constant and closest to the nozzle opening 280 (the lowest position).

A line 300 indicated by an alternate long and short dashed line in FIG. 9B intersects with the nozzle axis 281A and is parallel with the Y direction (see FIG. 5). The barycenter of the planar shape of the circulation outlet 226A and the barycenter of the planar shape of the circulation outlet 227A are positioned along the line 300.

Furthermore, the circulation outlets 226A and 227A have the same shapes and sectional areas. In the case where the flow rates of the individual circulation channels 226 and 227 are equal to each other, setting of the shapes and sectional areas of the circulation outlets 226A and 227A to be the same can achieve a constant flow velocity of ink flowing from the nozzle 281, passing through the circulation outlets 226A and 227A and flowing to the individual circulation channels 226 and 227, and maintain symmetry of the ink flow in the nozzle 281 (cause the flow of ink to be symmetric with respect to the nozzle axis 218A).

Here, the "same" for the shape and sectional area may allow a difference (error) within an extent capable of exerting an operational effect where "the flow velocity of ink becomes constant".

Figure 10:
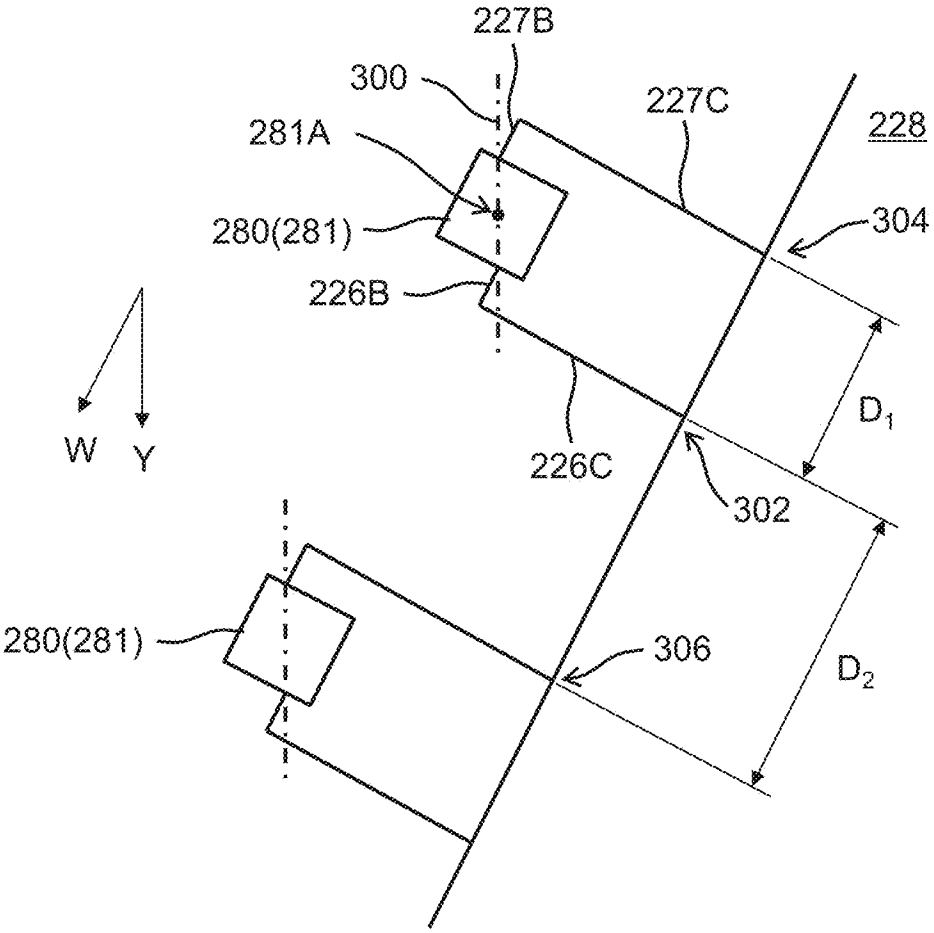
FIG. 10 is a diagram schematically illustrating an example of communication between the individual circulation channels and a common circulation channel.

FIG. 10 is a diagram schematically illustrating an example of communication between the individual circulation channels 226 (226B, 226C) and 227 (227B, 227C) and the common circulation channel 228. As illustrated in this diagram, the individual circulation channels 226 and 227 communicating with the one nozzle 281, in turn, communicate with the same common circulation channel 228 but do not intersect.

The "same common circulation channel" means herein each common circulation channel 228 branched off from the circulation main channel 228A illustrated in FIG. 5. That is, the common circulation channel 228 illustrated in FIG. 10 is one of the plurality of common circulation channels 228 illustrated in FIG. 5. At one common circulation channel 228, a communication port 302 with the individual circulation channel 226, and a communication port 304 with individual circulation channel 227 are formed.

The communication port 302 and the communication port 304 which communicate with the same (one) nozzle 281 are arranged at adjacent positions. The pressure loss at the common circulation channel 228 between communication port 302 and the communication port 304 is within an extent in which the pressure loss can be ignored.

The "extent in which the pressure loss can be ignored" means that $\Delta R/R_1 \leq 0.001$ (0.1 percent) and $\Delta R/R_2 \leq 0.001$ (0.1 percent) are satisfied, provided that the combined fluid resistance of the individual circulation channel 226 is $R_1$, the combined fluid resistance of the individual circulation channel 227 is $R_2$, and fluid resistance between the communication port 302 and the communication port 304 is $\Delta R$.

In order to achieve the same flow rates in the individual circulation channels 226 and 227, $R_1$ and $R_2$ are required to be set such that $(R_1 \times V_1)+(\Delta R \times V)=(R_2 \times V_2)$ is satisfied provided that the flow rate in the individual circulation channel 226 is $V_1$, the flow rate in the individual circulation channel 227 is $V_2$, and the flow rate in the common circulation channel is V.

However, the flow rate V in the common circulation channel changes according to the flow rate for circulation. Thus, $\Delta R \times V$ can be regarded as zero by setting of the $\Delta R$ to be sufficiently small with respect to $R_1$ and $R_2$, thereby substantially achieving $(R_1 \times V_1)=(R_2 \times V_2)$.

In consideration of the structures and flow rates of the individual circulation channels 226 and 227 and the structure and flow rate of the common circulation channel 228, it can be regarded that it is sufficient that the value of $R_1$ and the value of $\Delta R$ with respect to the value of $R_1$ is 0.1 percent (0.001) or less.

The distance $D_1$ between the communication port 302 and the communication port 304 which communicate with the same nozzle 281 (the upper nozzle in FIG. 10) is less than the distance (the channel length of the common circulation channel 228) $D_2$ between the communication port 306 (the communication port closer to the communication port 302 among two communication ports) communicating with the adjacent nozzle 281 (the lower nozzle in this diagram) and the communication port 302 ($D_1<D_2$).

In the case where at least three communication ports communicate with the same nozzle 281, the maximum value of the distances between at least three communication ports may be set to $D_1$.

The combined fluid resistance of the individual circulation channel 226 communicating with one nozzle 281 is identical to the combined fluid resistance of the individual circulation channel 227. That is, the relationship between the combined fluid resistance $R_1$ of the individual circulation channel 226 and the combined fluid resistance $R_2$ of the individual circulation channel 227 is $R_1=R_2$.

The identical (combined) fluid resistance described here includes a substantially identical fluid resistance which is different but can exert an operational effect analogous to the case where the fluid resistance is the same.

In the case where at least three communication ports communicate with the same nozzle 281, the maximum value of fluid resistances between at least three communication ports may be set to $\Delta R$.

The individual circulation channel 226 illustrated in FIG. 10 includes: the first channel 226B communicating with the circulation outlet 226A; and the second channel 226C communicating with the communication port 302, in which the first channel 226B is orthogonal to (intersects with) the second channel 226C.

Likewise, the individual circulation channel 227 includes: the first channel 227B communicating with the circulation outlet 227A; and the second channel 227C communicating with the communication port 304, in which the first channel 226B is orthogonal to (intersects with) the second channel 227C.

Note that, only if a condition is satisfied where the flow rate of ink circulating from the nozzle 281 to the common circulation channel 228 via the individual circulation channel 226 is substantially identical to the flow rate of ink circulating from the nozzle 281 to the common circulation channel 228 via the individual circulation channel 227, the shapes of the individual circulation channels 226 and 227 are not limited to the example illustrated in FIG. 10.

In consideration of symmetry of flow of ink with respect to the nozzle axis 281A, an embodiment is preferred where the first channel 226B of the individual circulation channel 226 and the first channel 227B of the individual circulation channel 227 be arranged symmetrically with respect to the nozzle axis 281A.

An embodiment is preferred where the first channel 226B of the individual circulation channel 226 is parallel to the first channel 227B of the individual circulation channel 227.

Another embodiment is also preferred where the fluid resistance $R_{11}$ of the first channel 226B of the individual circulation channel 226 and the fluid resistance $R_{21}$ of the first channel 227B of the individual circulation channel 227 have the same resistance ($R_{11}=R_{21}$), and the fluid resistance $R_{12}$ of the second channel 226C of the individual circulation channel 226 and the fluid resistance $R_{22}$ of the second channel 227C of the individual circulation channel 227 have the same resistance ($R_{12}=R_{22}$).

Furthermore, in the embodiment illustrated in FIG. 10, the communication directions of the individual circulation channels 226 and 227 at the respective circulation outlets 226A and 227A are parallel to the Y direction (parallel to the Y direction, and the line 300 passing along the nozzle axis 281A). Setting of the communication directions of the individual circulation channels 226 and 227 parallel to the Y direction causes the ejection bending parallel to the Y direction even if ejection bending occurs owing to unevenness of flow of ink in the nozzle 281.

In image formation through use of the full line type inkjet head 56, ejection bending in a direction parallel to the relative movement direction between the inkjet head 56 and the paper P can be corrected through adjusting ejection timing of each nozzle.

Figure 11:
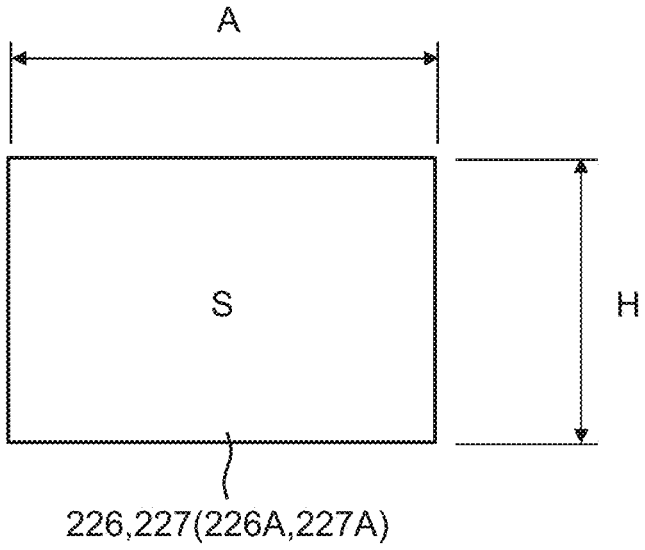
FIG. 11 is a diagram illustrating a relationship between a sectional area and a perimeter of the individual circulation channel.

FIG. 11 is a diagram illustrating a relationship between the sectional area of each of the individual circulation channels 226 and 227 (the area of each of the circulation outlets 226A and 227A) and the perimeter. The "sectional area of each of the individual circulation channels" described here is a sectional area along a sectional line orthogonal to the longitudinal direction of each of the individual circulation channels 226 and 227. The sectional area of each of the individual circulation channels 226 and 227 at the circulation outlets 226A and 227A is identical to the area of each of the circulation outlets 226A and 227A.

A value acquired by dividing the perimeter (outer peripheral length: $2\times A+2\times H$) of the section by the sectional area S of each of the individual circulation channels 226 and 227 is set smaller, thereby allowing the flow velocity of ink passing through the section in question to be smaller even if the flow rate per unit time of ink passing through the section in question is maintained. Accordingly, unevenness of flow can be suppressed.

Provided that the sectional shape of each of the individual circulation channels 226 and 227 is a square, the sectional area and the perimeter become equal to each other (sectional area/perimeter=1) and the value acquired by dividing the sectional area by the perimeter becomes the minimum.

According to the inkjet head and the inkjet recording apparatus which are configured as described above, the plurality of individual circulation channels which circulate ink in the nozzle to the common circulation channel are provided, the plurality of individual circulation channels are arranged symmetrically with respect to the nozzle axis, each individual circulation channel communicates with the same common circulation channel, and the flow rate of ink circulating from the nozzle to the common circulation channel via each circulation outlet and each individual circulation channel is set to substantially identical, thereby preventing occurrence of ejection bending due to ink circulation in the nozzle.

Furthermore, the fluid resistance (combined fluid resistance) of each individual circulation channel is set to substantially identical. Accordingly, the flow rate of ink circulating from the nozzle to the common circulation channel via each individual circulation channel can be substantially identical.

Moreover, communication ports between the individual circulation channels and the common circulation channels are arranged close to each other, and the fluid resistance ($\Delta R$) between the communication ports is set to be the fluid resistance ($R_1$, $R_2$) of each individual circulation channel of 0.001 (0.1 percent) or less. Accordingly, the pressure loss between the communication ports of the common circulation channel becomes within an extent which can be ignored, and the flow rate of ink circulating from the nozzle to the common circulation channel can be substantially identical.

The distance between the communication ports communicating with the same nozzle is set less than the distance with respect to the communication ports communicating with another adjacent nozzle. Accordingly, close arrangement of the communication ports communicating with the same nozzle is achieved.

Furthermore, the communication direction of the individual circulation channel is set parallel to the Y direction. Accordingly, even when the flow of ink in the nozzle is uneven, the direction of ejection bending is parallel to the Y direction, thereby allowing ejection bending to be corrected by adjusting the ejection timing of each nozzle.

The value acquired by dividing the perimeter of the section of the individual circulation channel by the sectional area thereof is set to be smaller. Accordingly, even if the flow rate per unit time of ink passing through the section in question is maintained, the flow velocity of ink passing through the section in question can be smaller, which can suppress unevenness of flow.

This example exemplifies the individual circulation channels 226 and 227 having a uniform sectional size. Alternatively, the sectional sizes of the individual circulation channels 226 and 227 may partially vary. The sectional sizes from the circulation outlets 226A and 227A or the communication ports 302 and 304 to the individual circulation channels 226 and 227 may gradually vary.

This example mainly exemplifies the embodiment where the two individual circulation channels are arranged rotationally symmetrically with respect to the nozzle axis 281A as a rotational axis. Alternatively, the number of individual circulation channels is an odd number at least three. Another embodiment where three individual circulation channels are arranged rotationally symmetrically by 120° with respect to the nozzle axis as the rotational axis, and still another embodiment where five individual circulation channels are arranged rotationally symmetrically by 72° with respect to the nozzle axis as the rotational axis may be adopted.

[Another Arrangement Example of Individual Circulation Channel]

Figure 12:
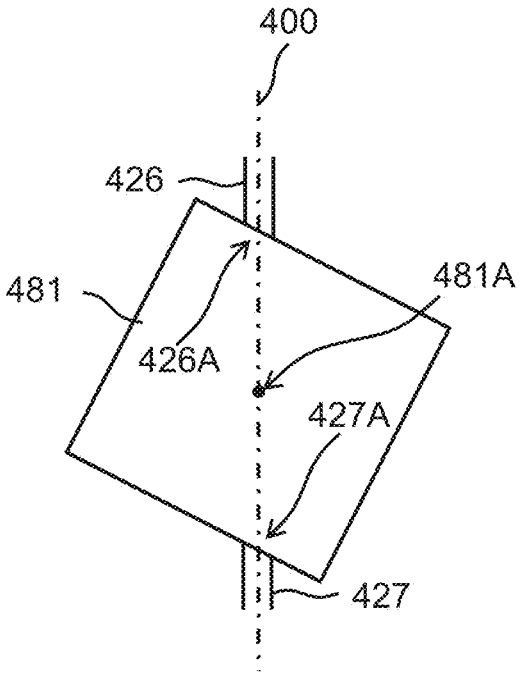
FIG. 12 is a diagram illustrating another arrangement example of an individual circulation channel.

FIG. 12 is a diagram illustrating another arrangement example of an individual circulation channel. Each of the individual circulation channels 426 and 427 illustrated in this diagram intersects with the nozzle axis 481A, and is arranged along a line 400 (indicated by an alternate long and short dashed line) parallel to the Y direction (see FIG. 10).

A surface on which a circulation outlet 426A of a nozzle 481 is provided and the individual circulation channel 426 intersect but are not orthogonal to each other. A surface on which a circulation outlet 427A is provided and the circulation outlet 427A intersect but are not orthogonal to each other.

At a position where the individual circulation channels 426 and 427 communicate with the common circulation channel, not illustrated, (see FIG. 10), the individual circulation channels 426 and 427 may be orthogonal to the common circulation channel, or obliquely intersect therewith without being orthogonal thereto.

[Description on Example of Configuration Where Four or More Individual Circulation Channels are Arranged]

Figure 13:
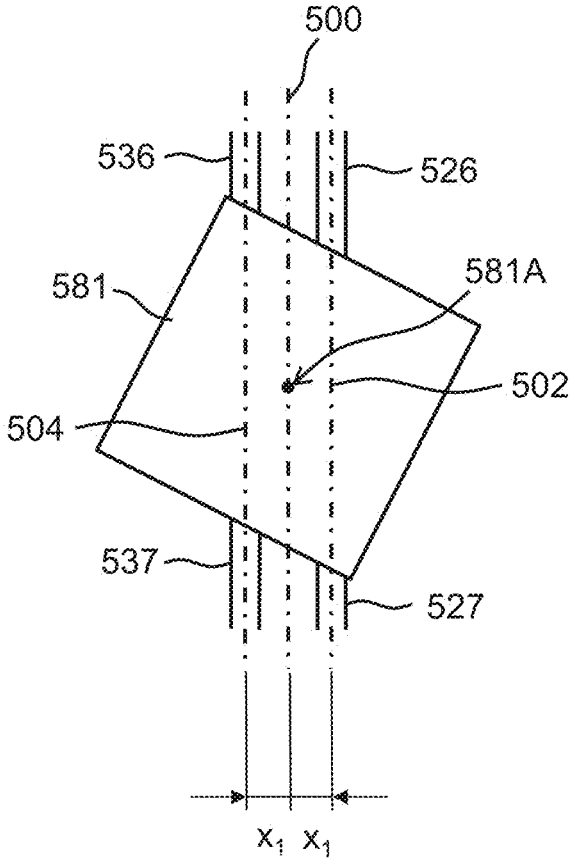
FIG. 13 is a diagram illustrating an example of a configuration including four individual circulation channels.

FIG. 13 is a diagram illustrating an example of the configuration including four individual circulation channels. A nozzle 581 illustrated in this diagram communicates with four individual circulation channels 526, 527, 536 and 537. The four individual circulation channels 526, 527, 536 and 537 communicate with the same common circulation channel (not illustrated; see FIG. 10).

An alternate long and short dashed line designated by reference numeral 500 intersects with a nozzle axis 581A and is parallel to the Y direction (see FIG. 10). Two alternate long and short dashed lines designated by reference numerals 502 and 504 are parallel to the Y direction, and equidistant from the line 500 in the X direction (see FIG. 5).

As illustrated in this diagram, the distance between the lines 500 and 502 and the distance between the lines 500 and 504 are each $x_1$.

In the embodiment illustrated in this diagram, the individual circulation channels 526 and 527 are formed along the line 502. The individual circulation channels 536 and 537 are formed along the line 504. That is, the individual circulation channels 526 and 527 and the individual circulation channels 536 and 537 are formed so as to intersect with the nozzle axis 581A in the X direction, and be equidistant from the line 500 parallel to the Y direction and be along the parallel direction to the Y direction.

In addition to the embodiment illustrated in FIG. 13, two individual circulation channels can be added along the line 500 to implement another embodiment including six individual circulation channels. Still another embodiment may be implemented which includes more individual circulation channels.

According to the aforementioned embodiments, in the nozzle having a sectional (planar) shape of a square (quadrilateral), the circulation outlets are formed on the opposite two surfaces (the embodiment where the nozzle communicates with the individual circulation channels on the two opposite surfaces of the nozzle). Alternatively, in the case where the condition "symmetric arrangement with respect to the nozzle axis" is satisfied, the circulation outlets may be formed on the two surfaces intersecting with each other.

All of the four individual circulation channels illustrated in FIG. 13 may communicate with the same common circulation channel. Alternatively, each two of the individual circulation channels may communicate with a different common circulation channel.

[Description on Example of Configuration Including Individual Circulation Channel Having Branch Structure]

Figure 14:
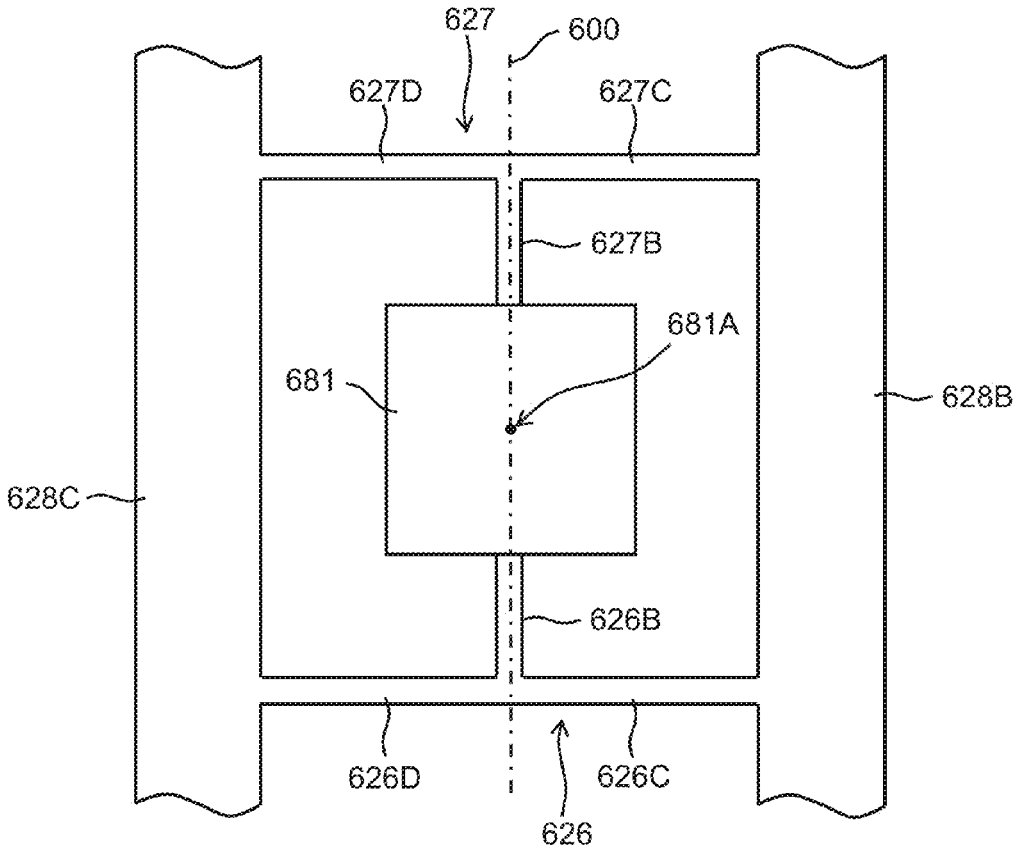
FIG. 14 is a diagram illustrating an example of a configuration including an individual circulation channel having a branch structure.

FIG. 14 is a diagram illustrating an example of the configuration including an individual circulation channel having a branch structure. In the configuration including the common circulation channels on both sides in the V direction of the nozzle array (see FIG. 5) along the W direction, the individual circulation channel may be branched off and the branched individual circulation channels may communicate with different common circulation channels.

An individual circulation channel 626 (main channel 626B) illustrated in FIG. 14 is branched off into two at the middle thereof. One of the individual circulation channels (branch channel) 626C communicates with one common circulation channel 628B. The other individual circulation channel (branch channel) 626D communicates with the other common circulation channel 628C.

Likewise, the individual circulation channel 627 (main channel 627B) is branched off into two at the middle thereof. One of the individual circulation channels (branch channel) 627C communicates with one common circulation channel 628B. The other individual circulation channel (branch channel) 627D communicates with the other common circulation channel 628C.

That is, the individual circulation channel including the main channel 626B and the branch channel 626C, and the individual circulation channel including the main channel 627B and the branch channel 627C communicate with the same common circulation channel 628B. The individual circulation channel including the main channel 626B and the branch channel 626D, and the individual circulation channel including the main channel 627B and the branch channel 627D communicate with the same common circulation channel 628C.

An alternate long and short dashed line designated by reference numeral 600 intersects with the nozzle axis 681A and is parallel to the Y direction (see FIG. 10).

In the embodiment illustrated in FIG. 14, provided that the fluid resistance of the main channel 626B is $R_{111}$, the fluid resistance of the branch channel 626C is $R_{112}$, the fluid resistance of the branch channel 626D is $R_{113}$, and the fluid resistance of the main channel 627B is $R_{211}$, the fluid resistance of the branch channel 627C is $R_{212}$, and the fluid resistance of the branch channel 627D is $R_{213}$, a relationship of $R_{111}+(R_{112}\times R_{113})/(R_{112}+R_{113})=R_{211}+(R_{212}\times R_{213})/(R_{212}+R_{213})$ is satisfied.

That is, the combined fluid resistance of the individual circulation channel 626 including the main channel 626B and the branch channels 626C and 626D, and the combined fluid resistance of the individual circulation channel 627 including the main channel 627B and the branch channels 627C and 627D have the same structure, which can achieve the same flow rate of ink circulating from the nozzle 681 to the common circulation channels 628B and 628C via each individual circulation channel, and suppresses ejection bending due to circulation of ink in the nozzle 681.

Furthermore, the one nozzle 681 communicates with the plurality of common circulation channels 628B and 628C. Accordingly, even in case of occurrence of clogging (abnormality) due to occurrence of bubbles or the like on one (a part of) the common circulation channel, ink in the nozzle 681 can be circulated using another common circulation channel where no abnormality occurs, and occurrence of ejection failure (abnormal ejection) due to drying (increase in viscosity) of ink in the nozzle 681 can be prevented.

[Description on Another Example of Configuration of Individual Circulation Channel]

Figure 15:
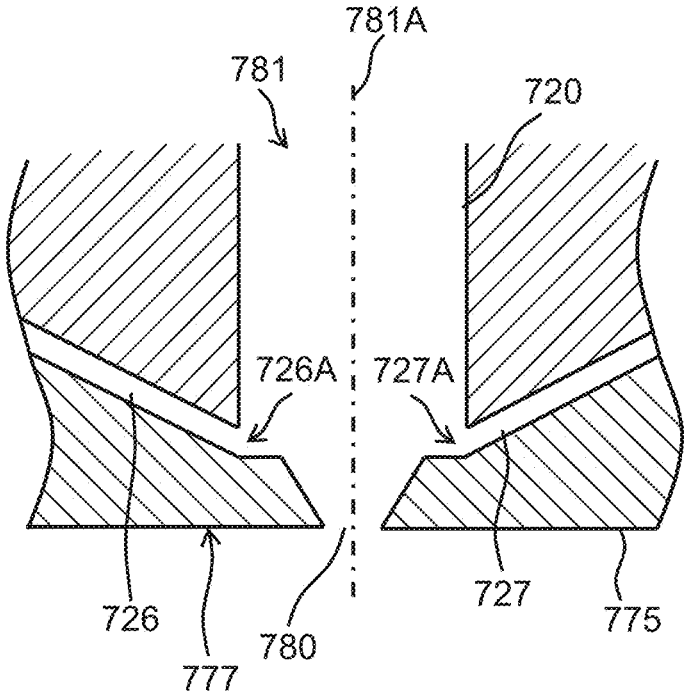
FIG. 15 is a diagram illustrating an example of another structure of an individual circulation channel.

FIG. 15 is a diagram illustrating an example of another configuration of the individual circulation channel. An individual circulation channel 726 illustrated in this diagram is formed in an orientation obliquely upward from the circulation outlet 726A. Likewise, the individual circulation channel 727 is formed in an orientation obliquely upward from the circulation outlet 727A.

The "upward" here means a direction opposite to the ink ejection direction in the case where the ink ejecting direction is oriented vertically downward.

That is, the individual circulation channels 726 and 727 are formed obliquely upward from the circulation outlets 726A and 727A, thereby facilitating ejection of bubbles having occurred in the nozzle 781, via the individual circulation channels 726 and 727.

Furthermore, bubbles entering the individual circulation channels 726 and 727 from the nozzle 781 can be eliminated favorably.

Reference numeral 720 designates a nozzle communication portion. Reference numeral 775 designates the nozzle plate. Reference numeral 777 designates the nozzle surface. An alternate long and short dashed line designated by reference numeral 781A is the nozzle axis.

The inkjet head and the inkjet recording apparatus which have been described above may appropriately be changed, further include an additional element, and be deleted within an extent without departing from the gist of the presently disclosed subject matter. The examples of the configurations described above may be appropriately combined.

This specification exemplifies the inkjet recording apparatus as an example of the liquid ejection apparatus. Alternatively, the presently disclosed subject matter is widely applicable also to liquid ejection apparatuses other than the inkjet recording apparatus.

[Invention Disclosed by this Specification]

As grasped from the above detailed description on the embodiments of the presently disclosed subject matter, this specification includes disclosure of various technological thoughts including at least following aspects.

(First Aspect): A liquid ejection head, including: a nozzle including a nozzle opening through which liquid is ejected, and a nozzle communication channel communicating at one end thereof with the nozzle opening; a liquid chamber which communicates with another end of the nozzle communication channel; a pressurizing element which is provided on the liquid chamber, the pressurizing element configured to pressurize liquid in the liquid chamber; a plurality of circulation outlets which are formed at the nozzle; a plurality of individual circulation channels which communicate with the nozzle via each of the plurality of circulation outlets; and a common circulation channel at which a plurality of communication ports respectively communicating with the plurality of individual circulation channels are formed, wherein the nozzle has a structure where the plurality of circulation outlets are arranged symmetrically with respect to a nozzle axis which passes through a barycenter of the nozzle opening and is perpendicular to a nozzle opening surface, and the plurality of individual circulation channels respectively communicating with the plurality of circulation outlets further communicate with a same common circulation channel, and the circulation outlets have a structure where flow rates of liquid respectively passing through the circulation outlets when the liquid in the nozzle is circulated to the common circulation channel are the equal to each other.

According to the first aspect, the plurality of circulation outlets and the plurality of individual circulation channels through which liquid in the nozzle is circulated to the common circulation channel are provided. The plurality of circulation outlets respectively communicating with the individual circulation channels are arranged symmetrically with respect to the axis of the nozzle (a nozzle axis), and the flow rates of liquid passing through the respective circulation outlets during circulation from the nozzle to the common circulation channel via the respective individual circulation channels are the same. Accordingly, unevenness of flow of liquid in the nozzle is suppressed, and occurrence of ejection bending of liquid is suppressed even when the liquid is circulated from the nozzle to the common circulation channel for ejecting the liquid from the nozzle opening.

An example of the "symmetric arrangement with respect to the nozzle axis" may be rotational symmetry with respect to the nozzle axis as the rotational axis.

The "same flow rate" covers a "substantially identical flow rate" which exerts the same operational effects.

The aspect where the plurality of individual circulation channels communicate with the same common circulation channel covers an aspect where one common circulation channel communicates with the plurality of individual circulation channels communicating with the same nozzle, and an aspect which includes two (the plurality of) independent common circulation channels and in which each of the individual circulation channels communicating with the same nozzle is branched off at a middle thereof, and each of the branched individual circulation channels communicates with the corresponding common circulation channel.

Here, the independent common circulation channel includes the branch channels in a channel structure where the main channel is branched off into the plurality of branch channels.

(Second Aspect): The liquid ejection head according to the first aspect, wherein the plurality of individual circulation channels corresponding to the plurality of circulation outlets have structures where fluid resistance values of the plurality of individual circulation channels are equal to each other.

According to the second aspect, the fluid resistances of the plurality of individual circulation channels corresponding to the respective circulation outlets are configured to be the same. Accordingly, even if liquid is circulated from the nozzle to the common circulation channel via any circulation outlet, the flow rates of the liquid circulated from the nozzle to the common circulation channel can be substantially identical to each other.

The same fluid resistance covers substantially identical fluid resistances within an extent which exerts analogous operational effects.

The fluid resistance of the individual circulation channel in the structure where the individual circulation channels are branched off is the combined resistance of all the individual circulation channels.

(Third Aspect): The liquid ejection head according to the first or second aspect, wherein a maximum value of fluid resistances between a plurality of communication ports formed in the same common circulation channel communicating with a plurality of communication ports formed in a same nozzle via the plurality of individual circulation channels respectively communicating with the plurality of communication ports formed at the same nozzle is 0.1 percent or less of a minimum value of fluid resistance values of the plurality of individual circulation channels respectively communicating with the plurality of communication ports formed at the same nozzle.

According to the third aspect, the pressure loss between the plurality of communication ports communicating with the same nozzle can be substantially zero (ignorable). Even if the liquid is circulated from the nozzle to the common circulation channel via any of the individual circulation channels, the flow rates of the liquid circulated from the nozzle to the common circulation channel via the circulation outlets can be substantially identical to each other.

(Fourth Aspect): The liquid ejection head according to any one of the first to the third aspects, wherein a channel length of the common circulation channel communicating with a plurality of communication ports formed at the same common circulation channel communicating with a plurality of communication ports formed at a same nozzle via the plurality of individual circulation channels respectively communicating with the plurality of communication ports formed at the same nozzle is less than a channel length of the common circulation channel which connects a communication port closest to a communication port formed at the same common circulation channel communicating with other nozzle among the plurality of communication ports to a communication port formed in the same common circulation channel communicating with the other nozzle.

According to the fourth aspect, the plurality of communication ports communicating with the same nozzle are closely arranged. Accordingly, even if the liquid is circulated from the nozzle to the common circulation channel via any of the individual circulation channels, the flow rates of the liquid circulated from the nozzle to the common circulation channels can be substantially equal to each other.

(Fifth Aspect): The liquid ejection head according to any one of the first to the fourth aspects, wherein the plurality of individual circulation channels communicating with a same nozzle are arranged so as not to intersect with each other.

According to the fifth aspect, the plurality of the individual circulation channels communicating with the same nozzle are arranged so as not to intersect with each other. This arrangement can closely arrange the communication ports communicating with the plurality of the individual circulation channels.

(Sixth Aspect): The liquid ejection head according to any one of the first to fifth aspects, further including a plurality of the common circulation channels, wherein the individual circulation channels have a structure of branching off into a plurality of branch channels, and at least one of the branch channels has a structure of communicating with a common circulation channel different from a common circulation channel communicating with another branch channel, and the individual circulation channels have a structure where combined fluid resistance values of the individual circulation channels are equal to each other.

According to the sixth aspect, each of the individual circulation channels communicates with the plurality of the common circulation channels. Accordingly, even in case where abnormality occurs in any of the common circulation channels owing to bubble generation or the like, the liquid in the nozzle can be circulated using another common circulation channel.

(Seventh Aspect): The liquid ejection head according to any one of the first to the sixth aspects, wherein when an ejection direction of the liquid ejected from the nozzle is vertically downward, the individual circulation channels have a structure inclined opposite to the ejection direction of the liquid from the circulation outlet.

According to the seventh aspect, in the case where the ejection direction of the liquid ejected from the nozzle is arranged vertically downward, the individual circulation channel is inclined upward. Accordingly, bubbles, which tend to move upward, can be efficiently ejected from the nozzle to the common circulation channel.

(Eighth Aspect): A liquid ejection apparatus, including: a liquid ejection head configured to eject liquid; and a relative movement device configured to relatively move the liquid ejection head and a deposition target medium, wherein the liquid ejection head includes: a nozzle including a nozzle opening through which liquid is ejected, and a nozzle communication channel communicating at one end thereof with the nozzle opening; a liquid chamber which communicates with another end of the nozzle communication channel; a pressurizing element which is provided on the liquid chamber, the pressurizing element configured to pressurize liquid in the liquid chamber; a plurality of circulation outlets which are formed at the nozzle; a plurality of individual circulation channels which communicate with the nozzle via each of the plurality of circulation outlets; and a common circulation channel at which a plurality of communication ports respectively communicating with the plurality of individual circulation channels are formed, the nozzle has a structure where the plurality of circulation outlets are arranged symmetrically with respect to a nozzle axis which passes through a barycenter of the nozzle opening and is perpendicular to a nozzle opening surface, and the plurality of individual circulation channels respectively communicating with the plurality of circulation outlets further communicate with a same common circulation channel, and the circulation outlets have a structure where flow rates of liquid respectively passing through the circulation outlets when the liquid in the nozzle is circulated to the common circulation channel are equal to each other.

An example of the liquid ejection apparatus is an inkjet recording apparatus which ejects ink from the liquid ejection head (inkjet head) to form an image on a deposition target medium.

(Ninth Aspect): The liquid ejection apparatus according to the eighth aspect, wherein at least any of the plurality of individual circulation channels is arranged along a relative movement direction of the relative movement device.

The ninth aspect covers an aspect where each individual circulation channel includes a first channel formed along the relative movement direction and a second channel intersecting with the first channel.

(Tenth Aspect): The liquid ejection apparatus according to the eighth or ninth aspect, further including: at least four, even numbers of individual circulation channels, wherein the even number is four or more, wherein each of barycenters of the even number of circulation outlets communicating with the individual circulation channel is arranged on a first line along a relative movement direction of the relative movement device intersecting with a perpendicular line passing through a barycenter of the nozzle opening, or a second line equidistant from the first line in a direction orthogonal to the relative movement direction of the relative movement device.

In the case where the tenth aspect includes four circulation outlets (individual circulation channels), the four circulation outlets are arranged on a line along the relative movement direction intersecting the perpendicular line passing through the barycenter of the nozzle opening, and lines equidistant in the direction perpendicular to the relative movement direction.

(Eleventh Aspect): The liquid ejection apparatus according to the ninth aspect, further including: two individual circulation channels; and two circulation outlets respectively corresponding to the two individual circulation channels, wherein a barycenter of each of the two circulation outlets is arranged on the first line along the relative movement direction of the relative movement device intersecting with the perpendicular line passing through a barycenter of the nozzle opening.

According to the eleventh aspect, in the aspect including two circulation outlets, and two individual circulation channels communicating with the respective two circulation outlets, even in case where ejection bending occurs owing to circulation of liquid from the nozzle to the common circulation channel, the direction of the ejection bending is parallel to the relative movement direction. Accordingly, the ejection bending can be corrected by adjusting ejection timing.

(Twelfth Aspect): The liquid ejection apparatus according to any one of the eighth to eleventh aspects, wherein the liquid ejection head includes the liquid ejection head according to any one of the second to seventh aspects.

What is claimed is:

1. A liquid ejection head, comprising:

a nozzle including a nozzle opening through which liquid is ejected, and a nozzle communication channel communicating at one end thereof with the nozzle opening;

a liquid chamber which communicates with another end of the nozzle communication channel;

a pressurizing element which is provided on the liquid chamber, the pressurizing element configured to pressurize liquid in the liquid chamber;

a plurality of circulation outlets which are formed at the nozzle;

a plurality of individual circulation channels which communicate with the nozzle via each of the plurality of circulation outlets; and a common circulation channel at which a plurality of communication ports respectively communicating with the plurality of individual circulation channels are formed, wherein:

the nozzle has a structure where the plurality of circulation outlets are arranged symmetrically with respect to a nozzle axis which passes through a barycenter of the nozzle opening and is perpendicular to a nozzle opening surface, and the plurality of individual circulation channels respectively communicating with the plurality of circulation outlets further communicate with a same common circulation channel;

the circulation outlets have a structure where flow rates of liquid respectively passing through the circulation outlets when the liquid in the nozzle is circulated to the common circulation channel are equal to each other; and a channel length of the common circulation channel communicating with a plurality of communication ports formed at the same common circulation channel communicating with a plurality of communication ports formed at a same nozzle via the plurality of individual circulation channels respectively communicating with the plurality of communication ports formed at the same nozzle is less than a channel length of the common circulation channel which connects a communication port closest to a communication port formed at the same common circulation channel communicating with other nozzle among the plurality of communication ports to a communication port formed in the same common circulation channel communicating with the other nozzle.

2. The liquid ejection head according to claim 1, wherein the plurality of individual circulation channels corresponding to the plurality of circulation outlets have structures where fluid resistance values of the plurality of individual circulation channels are equal to each other.

3. The liquid ejection head according to claim 1, wherein a maximum value of fluid resistance values between a plurality of communication ports formed in the same common circulation channel communicating with a plurality of communication ports formed in a same nozzle via the plurality of individual circulation channels respectively communicating with the plurality of communication ports formed at the same nozzle is 0.1 percent or less of a minimum value of fluid resistance values of the plurality of individual circulation channels respectively communicating with the plurality of communication ports formed at the same nozzle.

4. The liquid ejection head according to claim 1, wherein the plurality of individual circulation channels communicating with a same nozzle are arranged so as not to intersect with each other.

5. The liquid ejection head according to claim 1, wherein when an ejection direction of the liquid ejected from the nozzle is vertically downward, the individual circulation channels have a structure inclined opposite to the ejection direction of the liquid from the circulation outlet.

6. A liquid ejection head, comprising:

a nozzle including a nozzle opening through which liquid is ejected, and a nozzle communication channel communicating at one end thereof with the nozzle opening;

a liquid chamber which communicates with another end of the nozzle communication channel;

a pressurizing element which is provided on the liquid chamber, the pressurizing element configured to pressurize liquid in the liquid chamber;

a plurality of circulation outlets which are formed at the nozzle;

a plurality of individual circulation channels which communicate with the nozzle via each of the plurality of circulation outlets; and a common circulation channel at which a plurality of communication ports respectively communicating with the plurality of individual circulation channels are formed, wherein:

the nozzle has a structure where the plurality of circulation outlets are arranged symmetrically with respect to a nozzle axis which passes through a barycenter of the nozzle opening and is perpendicular to a nozzle opening surface, and the plurality of individual circulation channels respectively communicating with the plurality of circulation outlets further communicate with a same common circulation channel;

the circulation outlets have a structure where flow rates of liquid respectively passing through the circulation outlets when the liquid in the nozzle is circulated to the common circulation channel are equal to each other;

the liquid ejection head further comprises a plurality of the common circulation channels;

the individual circulation channels have a structure of branching off into a plurality of branch channels, and at least one of the branch channels has a structure of communicating with a common circulation channel different from a common circulation channel communicating with another branch channel; and the individual circulation channels have a structure where combined fluid resistance values of the individual circulation channels are equal to each other.

7. A liquid ejection apparatus, comprising:

a liquid ejection head configured to eject liquid; and a movement device configured to move the liquid ejection head and a deposition target medium relative to each other in a movement direction, wherein:

the liquid ejection head comprises: a nozzle including a nozzle opening through which liquid is ejected, and a nozzle communication channel communicating at one end thereof with the nozzle opening; a liquid chamber which communicates with another end of the nozzle communication channel; a pressurizing element which is provided on the liquid chamber, the pressurizing element configured to pressurize liquid in the liquid chamber; a plurality of circulation outlets which are formed at the nozzle; a plurality of individual circulation channels which communicate with the nozzle via each of the plurality of circulation outlets; and a common circulation channel at which a plurality of communication ports respectively communicating with the plurality of individual circulation channels are formed;

the nozzle has a structure where the plurality of circulation outlets are arranged symmetrically with respect to a nozzle axis which passes through a barycenter of the nozzle opening and is perpendicular to a nozzle opening surface, and the plurality of individual circulation channels respectively communicating with the plurality of circulation outlets further communicate with a same common circulation channel; and the circulation outlets have a structure where flow rates of liquid respectively passing through the circulation outlets when the liquid in the nozzle is circulated to the common circulation channel are equal to each other; and a channel length of the common circulation channel communicating with a plurality of communication ports formed at the same common circulation channel communicating with a plurality of communication ports formed at a same nozzle via the plurality of individual circulation channels respectively communicating with the plurality of communication ports formed at the same nozzle is less than a channel length of the common circulation channel which connects a communication port closest to a communication port formed at the same common circulation channel communicating with other nozzle among the plurality of communication ports to a communication port formed in the same common circulation channel communicating with the other nozzle.

8. The liquid ejection apparatus according to claim 7, wherein at least any of the plurality of individual circulation channels is arranged along the movement direction.

9. The liquid ejection apparatus according to claim 7, further comprising:

even number of individual circulation channels, wherein the even number is four or more, wherein each of barycenters of the even number of circulation outlets communicating with the individual circulation channel is arranged on a first line along the movement direction intersecting with a perpendicular line passing through a barycenter of the nozzle opening, or a second line equidistant from the first line in a direction orthogonal to the movement direction.

10. The liquid ejection apparatus according to claim 8, further comprising:

two individual circulation channels; and two circulation outlets respectively corresponding to the two individual circulation channels, wherein a barycenter of each of the two circulation outlets is arranged on a line along the movement direction intersecting with the perpendicular line passing through the barycenter of the nozzle opening.

11. The liquid ejection apparatus according to claim 7, wherein the plurality of individual circulation channels corresponding to the plurality of circulation outlets have structures where fluid resistance values of the plurality of individual circulation channels are equal to each other.

12. The liquid ejection apparatus according to claim 7, wherein a maximum value of fluid resistance values between a plurality of communication ports formed in the same common circulation channel communicating with a plurality of communication ports formed in a same nozzle via the plurality of individual circulation channels respectively communicating with the plurality of communication ports formed at the same nozzle is 0.1 percent or less of a minimum value of fluid resistance values of the plurality of individual circulation channels respectively communicating with the plurality of communication ports formed at the same nozzle.

13. The liquid ejection apparatus according to claim 7, wherein the plurality of individual circulation channels communicating with a same nozzle are arranged so as not to intersect with each other.

14. The liquid ejection apparatus according to claim 7, further comprising a plurality of the common circulation channels, wherein the individual circulation channels have a structure of branching off into a plurality of branch channels, and at least one of the branch channels has a structure of communicating with a common circulation channel different from a common circulation channel communicating with another branch channel; and the individual circulation channels have a structure where combined fluid resistance values of the individual circulation channels are equal to each other.

15. The liquid ejection apparatus according to claim 7, wherein when an ejection direction of the liquid ejected from the nozzle is vertically downward, the individual circulation channels have a structure inclined opposite to the ejection direction of the liquid from the circulation outlet.

* * * * *